US007429236B2

(12) United States Patent
Dalebout et al.

(10) Patent No.: US 7,429,236 B2
(45) **Date of Patent: *Sep. 30, 2008**

(54) EXERCISE DEVICE WITH SINGLE RESILIENT ELONGATE ROD AND WEIGHT SELECTOR CONTROLLER

(75) Inventors: William T. Dalebout, North Logan, UT (US); Michael L. Olson, Logan, UT (US)

(73) Assignee: Icon IP, Inc., Logan, UT (US)

( * ) Notice: Subject to any disclaimer, the term of this patent is extended or adjusted under 35 U.S.C. 154(b) by 185 days.

This patent is subject to a terminal disclaimer.

(21) Appl. No.: 10/968,250

(22) Filed: Oct. 19, 2004

(65) Prior Publication Data

US 2005/0143230 A1 Jun. 30, 2005

Related U.S. Application Data

(63) Continuation-in-part of application No. 10/647,729, filed on Aug. 25, 2003.

(51) Int. Cl.
*A63B 21/02* (2006.01)
*A63B 21/06* (2006.01)
*A63B 21/00* (2006.01)

(52) U.S. Cl. ..... 482/123; 482/94; 482/121; 482/133

(58) Field of Classification Search ..... 482/5, 482/129, 130, 139, 123, 100–3, 92, 94; 124/23.1, 124/24.1

See application file for complete search history.

(56) References Cited

U.S. PATENT DOCUMENTS 9,595 A * 5/1853 Hinsdale ..... 482/144
9,695 A 5/1853 Hinsdale
192,338 A 6/1877 Marshall
325,435 A 9/1885 North
428,912 A 5/1890 Holmes
484,352 A 10/1892 Ayton
588,350 A 8/1897 Perkins
610,716 A 9/1898 Marshall (Continued)

FOREIGN PATENT DOCUMENTS

DE 23 46 105 3/1975

(Continued)

OTHER PUBLICATIONS

MegaFitness.com, *Band Flex Home Gym*, printed Aug. 14, 2002, Copyright 1997-2002, 5 pgs.

(Continued)

*Primary Examiner*—S. R. Crow
*Assistant Examiner*—Allana Lewin
(74) *Attorney, Agent, or Firm*—Workman Nydegger

(57) ABSTRACT

An exercise apparatus with a single resistant rod configured to provide resistance for use in exercise and an electronic weight selector mechanism for use with a resistance rod having a variable resistance system and an electronic selector control. The weight selector control includes a bi-directional control and a plurality of indicia. The bi-directional control allows the user to change the amount of resistance provided by the single resilient elongate rod in combination with the variable resistance system. The plurality of indicia allows the user to monitor the amount and direction of change in resistance while operating the bi-directional control.

47 Claims, 10 Drawing Sheets

U.S. PATENT DOCUMENTS 685,788 A 11/1901 McFadden
754,992 A 3/1904 Grabner
807,670 A 12/1905 Grabner
852,193 A 4/1907 McMillan
964,745 A 7/1910 Blakoe
1,019,861 A 3/1912 Titus
1,115,826 A 11/1914 Johnson
1,123,272 A 1/1915 Goodman
1,144,085 A 6/1915 Abplanalp
1,495,278 A 5/1924 Titus
1,539,214 A 5/1925 Shockey
1,576,474 A 3/1926 Walker
1,585,748 A * 5/1926 Wendelken ..... 482/143
1,698,831 A 1/1929 Titus
2,346,105 A 4/1944 Haehnel ..... 66/127
2,456,017 A 12/1948 Park ..... 272/79
2,641,250 A 6/1953 Brockman
2,763,156 A 9/1956 Garigal ..... 73/381
D182,660 S 4/1958 Hastings ..... D34/5
2,843,858 A 7/1958 Bjorklund
2,855,200 A 10/1958 Blickman
2,968,337 A 1/1961 Bartlett ..... 155/18
3,000,628 A 9/1961 Kellogg ..... 269/205
3,342,485 A 9/1967 Gaul
3,370,584 A 2/1968 Girten
3,465,592 A 9/1969 Perrine ..... 73/379
3,567,219 A 3/1971 Foster
3,601,398 A 8/1971 Brochman ..... 273/26 E
3,638,941 A 2/1972 Kulkens ..... 272/83 R
3,640,528 A 2/1972 Proctor ..... 272/81
3,658,327 A 4/1972 Thiede
3,664,916 A 5/1972 Grellier et al.
3,690,655 A 9/1972 Chapman ..... 272/81
3,708,167 A 1/1973 Potgieter
3,797,624 A 3/1974 Powell et al.
3,858,874 A 1/1975 Weider ..... 272/79 R
3,884,464 A 5/1975 Evangelos ..... 272/79 R
3,891,207 A 6/1975 Helliwell
3,892,404 A 7/1975 Martucci ..... 272/79 R
3,918,710 A 11/1975 Niebojewski ..... 272/81
3,957,266 A 5/1976 Rice ..... 272/125
3,958,803 A 5/1976 Geisselbrecht ..... 272/135
3,981,500 A 9/1976 Ryan
4,026,548 A 5/1977 Birdwell ..... 272/136
4,063,727 A 12/1977 Hall
4,072,309 A 2/1978 Wilson ..... 272/136
4,074,409 A 2/1978 Smith ..... 29/235
4,076,237 A 2/1978 Dussia ..... 272/136
4,082,267 A 4/1978 Flavell ..... 272/125
4,131,701 A 12/1978 VanAuken ..... 428/36
4,157,181 A 6/1979 Cecka ..... 273/80
4,207,879 A 6/1980 Safadago et al.
4,231,568 A 11/1980 Riley et al. ..... 272/136
4,263,897 A 4/1981 Terayama
4,307,880 A 12/1981 Abram ..... 272/146
4,316,609 A 2/1982 Silberman ..... 272/118
4,316,610 A 2/1982 Hinds ..... 272/137
4,328,965 A 5/1982 Hatfield ..... 272/137
4,334,678 A 6/1982 Doyel ..... 272/141
4,354,675 A 10/1982 Barclay et al.
4,355,061 A 10/1982 Zeigler ..... 428/36
4,384,715 A 5/1983 Savio et al. ..... 272/136
4,426,077 A 1/1984 Becker ..... 272/118
4,428,577 A 1/1984 Weingardt ..... 272/135
4,441,708 A 4/1984 Brentham ..... 272/130
4,465,276 A 8/1984 Cox ..... 272/137
4,494,662 A 1/1985 Clymer
4,521,013 A 6/1985 Dofel ..... 272/136
4,569,519 A 2/1986 Mattox et al.
4,603,855 A 8/1986 Sebelle ..... 272/117
4,603,856 A 8/1986 Fiore
4,608,969 A 9/1986 Hamlin
4,620,701 A 11/1986 Mojden
4,620,704 A 11/1986 Shifferaw
4,647,040 A 3/1987 Ehrenfried
4,685,670 A 8/1987 Zinkin ..... 272/136
4,721,303 A 1/1988 Fitzpatrick ..... 272/117
4,725,057 A * 2/1988 Shifferaw ..... 482/130
4,741,530 A 5/1988 Wolf
4,743,010 A 5/1988 Geraci
4,750,738 A 6/1988 Dang
4,756,527 A 7/1988 Ledbetter
4,772,015 A 9/1988 Carlson et al.
4,790,596 A 12/1988 Shifferaw
4,826,158 A 5/1989 Fields, Jr.
4,844,453 A 7/1989 Hestilow
4,877,239 A 10/1989 Dela Rosa
4,898,381 A 2/1990 Gordon ..... 272/117
4,907,795 A 3/1990 Shaw et al.
5,005,832 A 4/1991 Van Der Hoeven ..... 272/137
5,022,377 A * 6/1991 Stevens ..... 124/23.1
5,039,088 A 8/1991 Shifferaw
5,108,090 A 4/1992 Reed
5,123,886 A * 6/1992 Cook ..... 482/129
5,141,483 A 8/1992 Smith
5,151,071 A 9/1992 Jain et al. ..... 482/101
5,176,601 A 1/1993 Reynolds
5,195,937 A * 3/1993 Engel et al. ..... 482/119
5,209,223 A 5/1993 McGorry et al.
5,211,617 A 5/1993 Millen ..... 482/127
5,254,066 A * 10/1993 Brown et al. ..... 482/137
5,316,534 A 5/1994 Dalebout et al.
5,318,495 A 6/1994 Malynowsky
5,320,591 A 6/1994 Harmon et al.
5,330,405 A 7/1994 Habing et al.
5,421,801 A 6/1995 Davies, III et al. ..... 482/131
5,472,399 A 12/1995 Szekely ..... 482/121
5,480,212 A 1/1996 Marconet
5,529,560 A 6/1996 Davies, III et al. ..... 482/131
5,626,547 A 5/1997 Davies, III et al. ..... 482/131
5,895,342 A 4/1999 Solland ..... 482/96
5,967,950 A 10/1999 Hsu ..... 482/96
6,003,294 A 12/1999 Fitzgerald et al.
6,011,134 A 1/2000 Marks et al.
6,027,429 A 2/2000 Daniels
6,082,346 A * 7/2000 Andrews et al. ..... 124/25.6
6,113,522 A * 9/2000 Fontenot et al. ..... 482/111
6,172,178 B1 1/2001 Koning et al.
6,217,495 B1 4/2001 Yalch
6,238,322 B1 5/2001 Hsu
6,238,323 B1 5/2001 Simonson
6,319,179 B1 11/2001 Hinds
6,335,100 B1 1/2002 Tominaga et al.
6,342,028 B1 * 1/2002 de Sane ..... 482/1
6,585,626 B2 7/2003 McBride ..... 482/130
6,595,905 B2 * 7/2003 McBride ..... 482/130
6,685,607 B1 * 2/2004 Olson ..... 482/142
7,197,029 B1 3/2007 Osterhout et al.
7,250,022 B2 7/2007 Dalebout et al. ..... 482/142
2005/0049121 A1 3/2005 Dalebout et al. ..... 482/93
2006/0035768 A1 2/2006 Kowallis et al.

FOREIGN PATENT DOCUMENTS

DE 2707550 8/1978
DE 2810632 C3 9/1979
DE 32 31 228 2/1984
DE 242563 2/1987
DE 3541980 6/1987
GB 5867 7/1913
GB 134847 1/1920
GB 325435 2/1930
GB 374240 6/1932
GB 496740 2/1937

| | | |
|---|---|---|
| GB | 466901 | 6/1937 |
| GB | 841537 | 7/1960 |
| GB | 1 326 704 | 8/1973 |
| JP | 365694 | 6/1950 |
| JP | 55-148571 | 11/1980 |
| WO | WO 01/85262 | 11/2001 |

OTHER PUBLICATIONS

LeonardFitness.com, *Bandflex Home Gym*, printed Aug. 14, 2002, Copyright 1999-2001, 4 pgs.
LeonardFitness.com, *Bowflex® Power Pro*, printed Aug. 20, 2002, Copyright 1999-2001, 3 pgs.
Website, www.bowflex.com, printed Sep. 17, 2002, 96 pgs.
Bowflex® Power Pro®, *Owner's Manual & Fitness Guide*, Copyright 2001, 80 pgs.
Bowflex® Power Prop®, *Assembly Manual*, Copyright 2000, 28 pgs.
*Lat Pulldown Attachment Assembly Instructions*, available, on information and belief, at least as early as Mar. 2002, 10 pgs.
Reviewboard.com, *Bowflex Power Pro XTLU*, printed Aug. 20, 2002, 2 pgs.
NickPicks.com, *As Seen on TV Bowflex*, printed Aug. 20, 2002, 3 pgs.
2002 Project Abstract (including "University of Wyoming Zero Gravity Construction"), printed Aug. 20, 2002, 9 pgs.
Bowflex Trainer, *Power Rod Resistance*, printed Aug. 20, 2002, 1 pg.
Battle for the Best Pecs, printed Aug. 20, 2002, 3 pgs.
Soloflex.com, *Soloflex®, Compound Barbell*, printed Sep. 17, 2002, 1 pg.
Bowflex.com, *Get Results with a Blowlflex Home Gym*, printed Sep. 17, 2002, Copyright 2002, 2 pgs.
Advertisement for Breitbart Muscle Building Apparatus, *Breibart Pupils Say it with Muscles!*, May 4, 1929 (3 pages).
Advertisement for Marcy Gymnasium Equipment Co., Physica Power publication, Apr. 1964 (1 page).
Advertisement for Weider's *Giant Multiplex Builder*, Muscle Power publication, Jan. 1949 (1 page).
Advertisement for Canadiana, *Big 16I*, Body-Building publication, Feb. 1962 (1 page).
Advertisement for *Broom's Advanced International Course*, SUPERMAN publication, Dec. 1938 (1 page).
Advertisement for *Universal Twister* in Athletik Sport Journal (Holland), 1972 (1 page).
RetroSearch, nerac.com, printed Jul. 2, 2004 (4 pages).
Advertisement for Weider's *Giant Multiplex Builder*, Muscle Power publication, Jan. 1949, (1 page).
Advertisement for *Universal Twister* in Athletik Sport Journal (Holland), 1972 (1 page).
Advertisement for *Brooms's Advanced International Course*, SUPERMAN publication, Dec. 1938 (1 page).
Advertisement for Marcy Gymnasium Equipment Co., Physical Power publication, Apr. 1964 (1 page).
Advertisement for Canadiana, *Big 16*, Body-Building publication, Feb. 1962 (1 page).
3422 Hall-Effect, Direction-Detection Sensor, Copyright 2001, 2003, Allegro MicroSystems, Inc. available online at www.allegromicro.com, pp. 1-10.
A3425 Ultra-Sensitive Dual-Channel Quadrature Hall-Effect Bipolar Switch, Copyright 2005, Allegro MicroSystems, Inc. available online at www.allegromicro.com, pp.1-21.
Owner's Manual for Impex Fitness Products, *Powerhouse Home Gym WM 1400*, Revised Jun. 30, 2000.
Office Action date Oct. 30, 2007, 4 pages, U.S. Appl. No. 10/647,729.
Office Action dated Apr. 17, 2007, 8 pages, U.S. Appl. No. 10/647,729.
Office Action dated Nov. 30, 2006, 4 pages, U.S. Appl. No. 10/647,729.
Office Action dated Aug. 24, 2005, 6 pages, U.S. Appl. No. 10/647,729.
Office Action dated Jan. 24, 2005, 7 pages, U.S. Appl. No. 10/647,729.
Amemdment "A" dated May 24, 2005, 22 pages, U.S. Appl. No. 10/647,729.
Amemdment "B" dated Jan. 24, 2006, 18 pages, U.S. Appl. No. 10/647,729.
Amemdment "C" dated Sep. 18, 2006, 20 pages, U.S. Appl. No. 10/647,729.
Amemdment "D" dated Jan. 11, 2007, 16 pages, U.S. Appl. No. 10/647,729.
Amemdment "E" dated Aug. 17, 2007, 20 pages, U.S. Appl. No. 10/647,729.
Amemdment "F" dated Jan. 22, 2008, 15 pages, U.S. Appl. No. 10/647,729, with Terminal Disclaimer dated Jan. 22, 2008, 2 pages.
Supplementary European Search Report dated May 9, 2008, from the European Patent Office, 6 pages.

* cited by examiner

EXERCISE DEVICE WITH SINGLE RESILIENT ELONGATE ROD AND WEIGHT SELECTOR CONTROLLER

CROSS REFERENCE TO RELATED APPLICATIONS

This application is a continuation-in-part of U.S. patent application Ser. No. 10/647,729 entitled, "Exercise Device with Centrally mounted Resistance Rod and Automatic Weight Selector Apparatus" filed Aug. 25, 2003.

BACKGROUND OF THE INVENTION

1. The Field of the Invention

The present invention relates to exercise devices. More specifically, the present invention relates to an exercise device having a resilient member for providing resistance for use in exercise and having a weight selector apparatus.

2. Background and Relevant Technology

Society in general is becoming more health-conscious. A result of this has been an increased demand for fitness devices that can be utilized to attain and maintain healthy levels of fitness. Multi-function exercise machines have been developed in response to this demand. Multi-function exercise machines are often adapted to be convenient to operate and store, while still providing the range of exercises necessary to provide effective all around fitness.

One type of conventional multi-function exercise machine utilizes a stack of weights to provide resistance needed by users during exercise. A user repetitively raises some, or all, of the weights in the weight stack. The force of gravity provides the resistance needed to allow the user to exercise. However, due to the mass of the weights, these machines are heavy and can be difficult for a home user to move.

Exercise machines that use flexible members to provide resistance have been developed as an alternative to weight stack machines. One such device available in the market incorporates two sets of flexible rods of varying resistance. The bottom end of each set of rods is attached to the base of the machine with the rods extending vertically upwards therefrom. A cable is attached to the top end of each set of rods by means of a large hook that is threaded through loops at the top end of each rod. By bundling the rods in this manner, the user can adjust the amount of resistance used during exercise. By displacing the cables, a user can utilize the resistance provided by the flexible rods to exercise various muscle groups.

However, the manner in which the hook apparatus must be used to bundle the flexible rods together is awkward, requiring the use of two hands, i.e. a first hand to hold the hook and a second hand to thread the hook through the loops on the rods. Since there are two sets of rods, this process must be done twice.

In addition, since there are two sets of rods, there are two independent sources of resistance. The two independent sources of resistance add a level of complexity to the use of the exercise apparatus. For example, the user must carefully monitor the amount of resistance used on each set of rods in order to maintain equilateral workout resistances for each side of the body. Moreover, the length of the user's stroke is limited to how far the ends of the flexible rods can be displaced, whereas certain exercises require a long stroke.

There is, therefore, a need for an improved exercise device that utilizes flexible members to provide resistance. There is a need for an exercise device having readily adjustable resistance that is simple and efficient. There is also a need for a device that has an efficient stroke length. There is additionally a need for a device that has a mechanism electronically adjusting the amount of resistance provided by the flexible members.

BRIEF SUMMARY OF THE INVENTION

The present invention relates to an exercise apparatus with a single resistance rod configured to provide resistance for use in exercise. The present invention also relates to a resistance assembly having at least a first guide member for use with at least a first resistance rod. Additionally, the present invention relates to a weight selector controller for controlling the amount of resistance provided by the at least first resistance rod.

In one embodiment of the present invention, a guide member is positioned adjacent at least one side of the resilient elongate rod. In another embodiment, a plurality of guide members are utilized with the single resilient elongate rod to maintain smooth and consistent movement of the single resilient elongate rod. In yet another embodiment, a first guide member is positioned adjacent one side of the single resilient elongate rod and a second guide member is positioned adjacent the opposite side of the single resilient elongate rod. The combination of the first and second guide member maintains smooth and consistent movement of the single resilient elongate rod when the single resilient elongate rod flexes.

The weight selector mechanism of the exercise apparatus includes a variable resistance system and a weight selector controller. In one embodiment, the weight selector controller comprises a bi-directional controller allowing a user to increase or decrease the amount of resistance provided by the single resilient elongate rod. For example, the bi-directional controller can comprise a two-way switch positioned on an upright support member of a lat tower. In another embodiment, the weight selector controller is positioned adjacent the variable resistance system. For example, in one embodiment the weight selector controller is positioned on the housing of the variable resistance system.

One or more indicia can be provided to show the amount of resistance provided by the single resilient elongate rod. For example, in one embodiment an electronic display which depicts the amount of resistance is provided. The one or more indicia can be positioned at the top of the housing such that the positioning of the cable relative to the indicia displays the amount of resistance provided by the variable resistance system. Manipulation of the bi-directional controller results in movement of the cable relative to the indicia. The configuration of the indicia allows the user to clearly monitor changes in the amount of resistance resulting from manipulation of the bi-directional controller.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
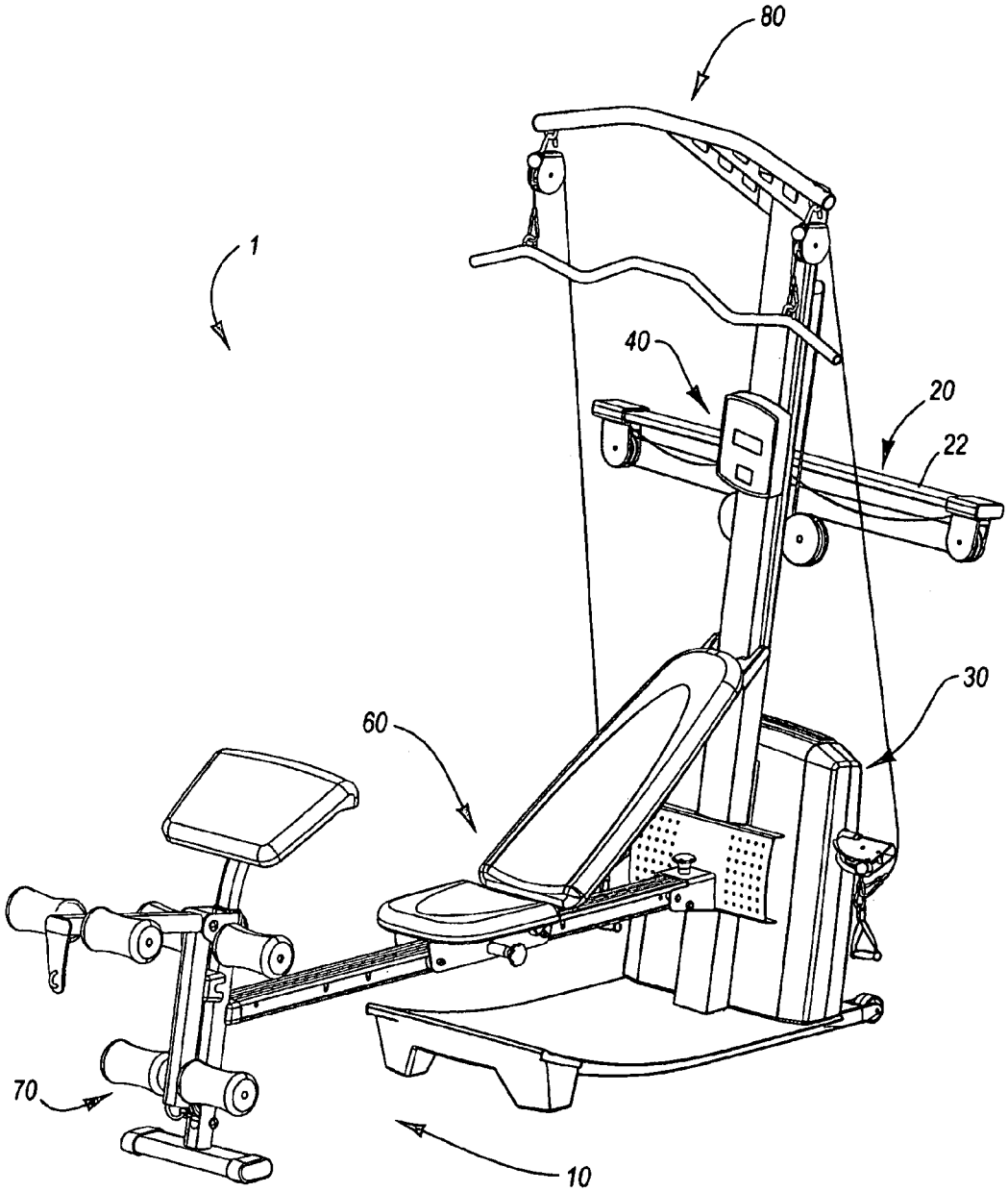
FIG. 1 is a perspective view that illustrates the exercise machine having a single resilient member according to one aspect of the present invention.

FIG. 1 illustrates an exercise apparatus 1 according to one aspect of the present invention. Exercise apparatus 1 provides a mechanism for allowing a user to undertake aerobic and anaerobic exercises in a home or institutional gym setting. Exercise apparatus 1 provides a mechanism for allowing a user to undertake a variety of types and configurations of exercises without needing an exercising partner to assist in the management of the resistance apparatuses during exercise. In the illustrated embodiment, exercise apparatus 1 includes a support frame 10, a resistance assembly 20, a variable resistance system 30, and a weight selector controller 40. The exercise apparatus 1 also includes a bench 60, a bicep/quadricep exerciser 70, and a lat tower 80. As will be appreciated by those skilled in the art, a variety of types and combinations of components can be utilized with the exercise apparatus without departing from the scope and spirit of the present invention.

Support frame 10 provides a structure upon which other components of exercise apparatus 1 are positioned. Additionally, support frame 10 provides stability to exercise apparatus 1 to provide a safe exercise environment. Resistance assembly 20 is positioned adjacent to support frame 10. Resistance assembly 20 includes a resilient elongate rod 22 and a cable a pulley system 340 (see FIG. 5). The single resilient elongate rod 22 provides resistance by flexing while the cable and pulley system 340 allows the user to utilize resistance from the resilient elongate rod 22 to perform exercise. Resilient elongate rod 22 flexes to provide resistance for use in exercise.

Variable resistance system 30 is coupled to resistance assembly 20. Variable resistance system 30 is configured to utilize resistance from resilient elongate rod 22 to provide a variable amount of resistance for use in exercise. Weight selector controller 40 is coupled to an upright support member of support frame 10 and electronically linked to variable resistance system 30. Weight selector controller 40 allows a user to select an amount of resistance to be used in exercise without having to manually adjust components of the system. Variable resistance system 30 and weight selector controller 40 collectively comprise an electronic resistance selector system according to one aspect of the present invention.

Exercise apparatus 1 also includes bench 60, bicep/quadricep exerciser 70, and lat tower 80. Bench 60 is coupled to support frame 10. Bench 60 provides a surface on which a user can sit or lay to perform certain exercise routines including the bench press, seated flies, bench curls, and the like. In the illustrated embodiment, bench 60 is slideable along a portion of support frame 10. Bicep/quadricep exerciser 70 is coupled to support frame 10 at a distal portion of support frame 10. Bicep/quadricep exerciser 70 allows the user to utilize resistance from single resilient elongate rod 22 to perform a variety of exercises including the bicep curl, quadricep lift, hamstring curl, and a variety of other types and configurations of exercises.

Lat tower 80 is also coupled to support frame 10. Lat tower 80 allows a user to perform lat pull down and other exercises. As will be appreciated by those skilled in the art, a variety of types and configurations of exercise machines can be utilized without departing from the scope and spirit of the present invention. For example, in one embodiment an exercise machine does not include all of the illustrated components, such as lat tower or bicep/quadriceps exerciser. In an alternative embodiment, an exercise machine having a single resistance rod is utilized with exercise components not illustrated in FIG. 1. In yet another embodiment, an electronic resistance selector system is used with a plurality of resistant rods.

Figure 2:
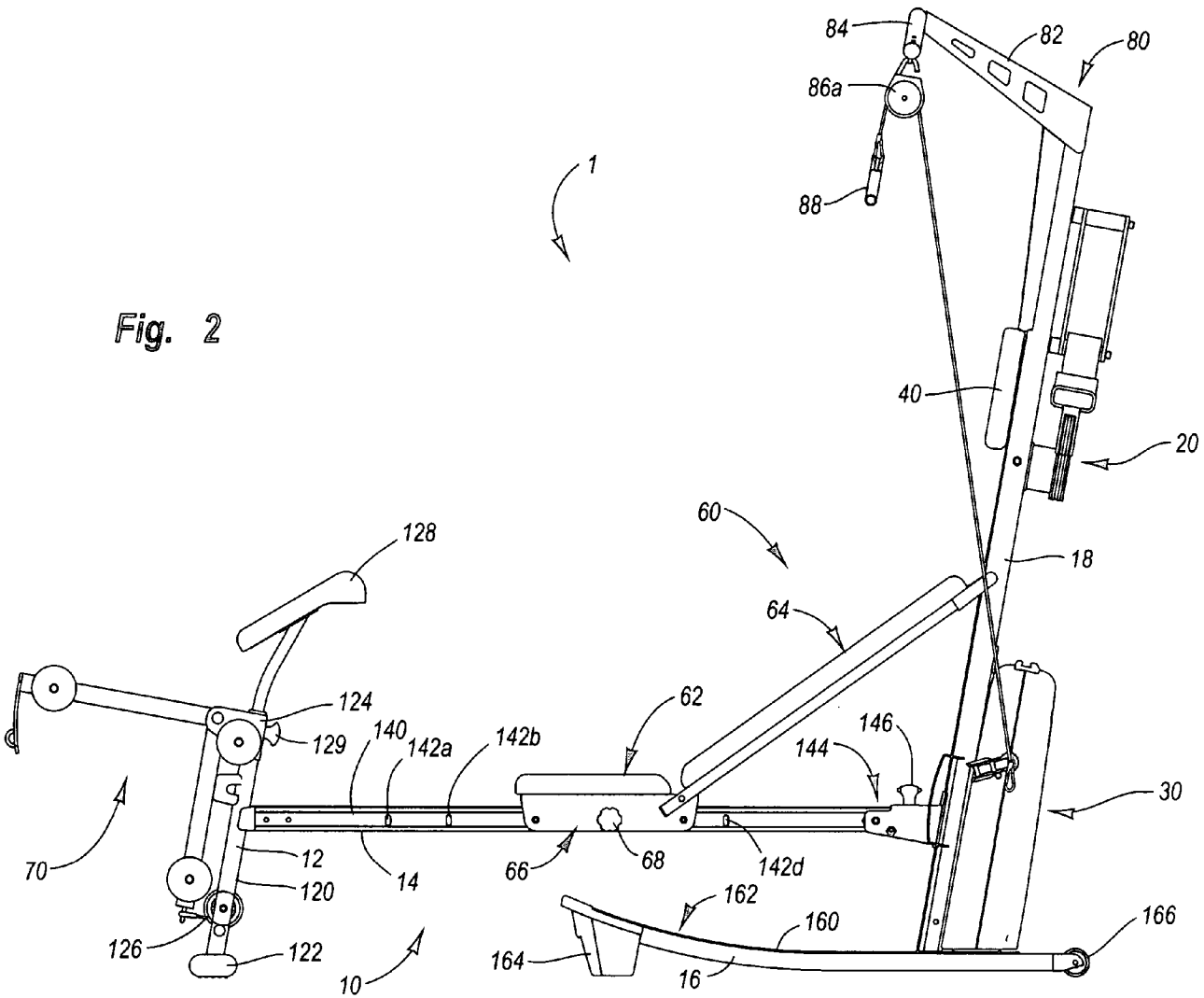
FIG. 2 is a side view of the exercise machine of FIG. 1 according to one aspect of the present invention.

FIG. 2 shows a side view of exercise apparatus 1 according to one aspect of the present invention. As previously discussed, exercise apparatus 1 includes a support frame 10, a bench 60, and a lat tower 80. Support frame 10 is adapted to provide stability to exercise machine 1 while also providing a structure to which additional components of exercise machine 1 can be coupled. Support frame 10 includes a leg support 12, a horizontal member 14, a support base 16, and an upright component support member 18.

Leg support 12 is positioned at the distal end of exercise apparatus 1. Leg support 12 provides an upright structural support to horizontal support member 14. Additionally, leg support 12 provides a structure for connecting bicep/quadriceps exerciser 70 to exercise apparatus 1. In the illustrated embodiment, leg support 12 includes an upright member 120 that connects to and supports horizontal member 14. Base support 122 is disposed upon an end of upright member 120. Base support 122 provides lateral support to upright member 120 to minimize lateral sliding or tipping of upright member 120.

Pulley 126 is positioned proximally to base support 122. Pulley 126 receives a cable (not shown) that extends from bicep/quadriceps exerciser 70 to variable resistance system 30 when a user is utilizing bicep/quadriceps exerciser 70. Connected to the opposite end of upright member 120, by way of a connector assembly 124 and upright member 120, is bicep/quadriceps exerciser 70. A locking pin 129 can be disposed through upright member 120 and engage pedestal 128, to maintain the position of pedestal 128 relative to upright member 120.

Horizontal support member 14 provides a structural support for bench 60 while also providing support for a user exercising thereon. Horizontal support member 14 is configured to guide bench 60 as a user changes the position of bench 60. Bench 60 can be locked in a plurality of positions along the length of horizontal support member 14 utilizing one or more of bores 142*a*-142*n* and a locking pin 68 associated with bench 60.

Horizontal support member 14 is coupled to leg support 12 and pivotally connected to upright component support member 18 utilizing pivot member 144. Horizontal support member 14 can be locked in a position relative to pivot member 144 by way of locking pin 146. Folding pivot 144 couples horizontal support member 14 to upright component support member 18. Folding pivot 144 allows a user to bias horizontal support member 14 and other distal portions of exercise machine 1 into a folded position. By allowing the distal portions of the exercise machine to be positioned in a folded position, folding pivot 144 allows the size and space required to store the exercise apparatus to be substantially reduced providing added convenience and storage capability. Folding locking pin 146 allows a user to lock the position of the horizontal support member relative to the upright component support member 18. Thus when the user desires to maintain a given position such as a folded storage position or unfolded exercise position, the user can utilize the folding locking pin to secure exercise apparatus 1 in the desired position.

Support base 16 is coupled to the lower portion of upright component support member 18. Support base 16 provides lateral stability to exercise apparatus 1 to provide a stable exercising environment. Additionally, support base 16 provides a deck on which various exercises can be performed by a user such as standing lat pull downs, and the like. An inclined portion 162 of support base 16 can be inclined relative to the surface of support base 16 upon which a user stands through the use of riser 164. Riser 164 provides lateral and structural support to base 16. A portion 160 of support base 16 can be generally parallel to the surface.

Generally, support deck 160 provides a surface allowing a user to rest his/her feet thereon thereby allowing a user to perform certain exercise routines such as lat pull downs, military press, and the like. Inclusion of an inclined portion 162 allows a user to position his/her feet at a desired angle during certain exercise routines. Further, this inclined portion 162 minimizes slippage of a user's feet on support base 16 during exercise routines. A variety of types and configurations of inclined portion 162 can be utilized without departing from the scope and spirit of the present invention. For example, in the illustrated embodiment, the inclined surface is gradually inclined from more planar portions of support deck, such as portion 160. In an alternative embodiment, inclined portion 162 rises sharply and at a distinct angle with respect to other portions of support deck, such as portion 160. In still another configuration, inclined portion 162 is not included in support base 16 so that support base 16 has the same planar orientation along its entire length.

Support base 16 further includes one or more rollers 166. Rollers 166 are positioned on the portion of support base 16 opposite riser 164. Rollers 166 provide a structural support member as well as a mechanism for moving exercise apparatus 1. The ability to move exercise apparatus 1 utilizing rollers 166 can be particularly beneficial when exerciser apparatus 1 is in a folded storage position. This allows a user to move exercise apparatus 1 to a closet, room corner, or other desired storage location when exercise apparatus 1 is not in use. In one embodiment, rollers 166 include a first and second roller positioned on opposite lateral sides of support base 16.

Upright component support member 18 is coupled to support base 16 and horizontal support member 14. Upright component support member 18 provides a structure on which other components of the exercise machine can be affixed. For example, in the illustrated embodiment, resistance assembly 20, variable resistance system 30, and a lat tower 80 are positioned on or next to upright component support member 18. As will be appreciated by those skilled in the art, a variety of types and configurations of support frames can be utilized without departing from the scope and spirit of the present invention. For example, in one embodiment, a plurality of leg supports are utilized. In an alternative embodiment, the other components of the exercise apparatus are connected to a secondary component instead of to the upright component support member. In an alternative embodiment, the distal components of the support frame include a support structure for a bench that is a separate stand alone component from the upright component support member and the support base.

Bench 60 is coupled to horizontal support member 14. Bench 60 provides a surface on which a user can rest to perform exercise routines. Bench 60 includes a seat member 62, a back support 64, a base 66, and a locking pin 68. In the illustrated embodiment, seat member 62 includes a padded surface. Seat member 62 is slidably coupled to horizontal support member 14 utilizing base 66. Back support 64 is pivotally coupled to seat member 62. Back support 64 provides a mechanism for supporting a user's back in either a sitting or inclined position during exercise routines a such as bench press, pectoral fly, and the like. Pivotal coupling between seat member 62 and back support 64 allows back support 64 to be placed in a variety of positions and at a variety of angles relative to seat member 62. In one embodiment, back support 64 is removable from seat member 62 permitting a user to conduct certain exercises and/or place exercise apparatus 1 in a folded position.

Base 66 provides a mechanism for coupling bench 60 to horizontal support member 14. Base 66, in this exemplary configuration, includes a plurality of roller wheels (not shown) positioned relative to horizontal support member 14 to allow bench 60 to slide relative to horizontal support member 14. Locking pin 68 is positioned on one side of base 66. Locking pin 68 provides a mechanism for securing a desired bench position. Locking pin 68 is configured to be positioned in bores 142*a*-142*n* to secure bench 60 during exercise or folding of exercise apparatus 1.

Lat tower 80 is positioned on the upper end of upright component support member 18. Lat tower 80 includes a support arm 82, a horizontal member 84, a pulley 86, and a lat bar 88. In the illustrated embodiment, support arm 82 is coupled at an angle to the upper portion of horizontal support member 14. Support arm 82 provides displacement from upright component support member 18 to allow a user to conduct lat pull down exercises with lat bar 88 being positioned at a desired angle relative to the user. Horizontal member 84 is coupled to support arm 82. Horizontal member 84 provides a mechanism for connecting pulleys 86*a* and 86*b* (not shown) at the desired lateral location to enable exercise with lat bar 88.

Pulleys 86*a* and 86*b* are adapted to route cables to lat bar 88. Pulleys 86*a, b* facilitate smooth and efficient movement of cables and thus lat bar 88. As will be appreciated by those skilled in the art, a variety of types and configurations of lat towers can be utilized without departing from the scope and spirit of the present invention. For example, in one embodiment, bearing members are used in place of pulleys 86*a, b*. In an alternative embodiment, the support arm and the horizontal member comprise an integral unit. In another embodiment, the horizontal member is coupled to an upright component support member having a curved upper portion providing the desired displacement from the upright component support member.

Figure 3:
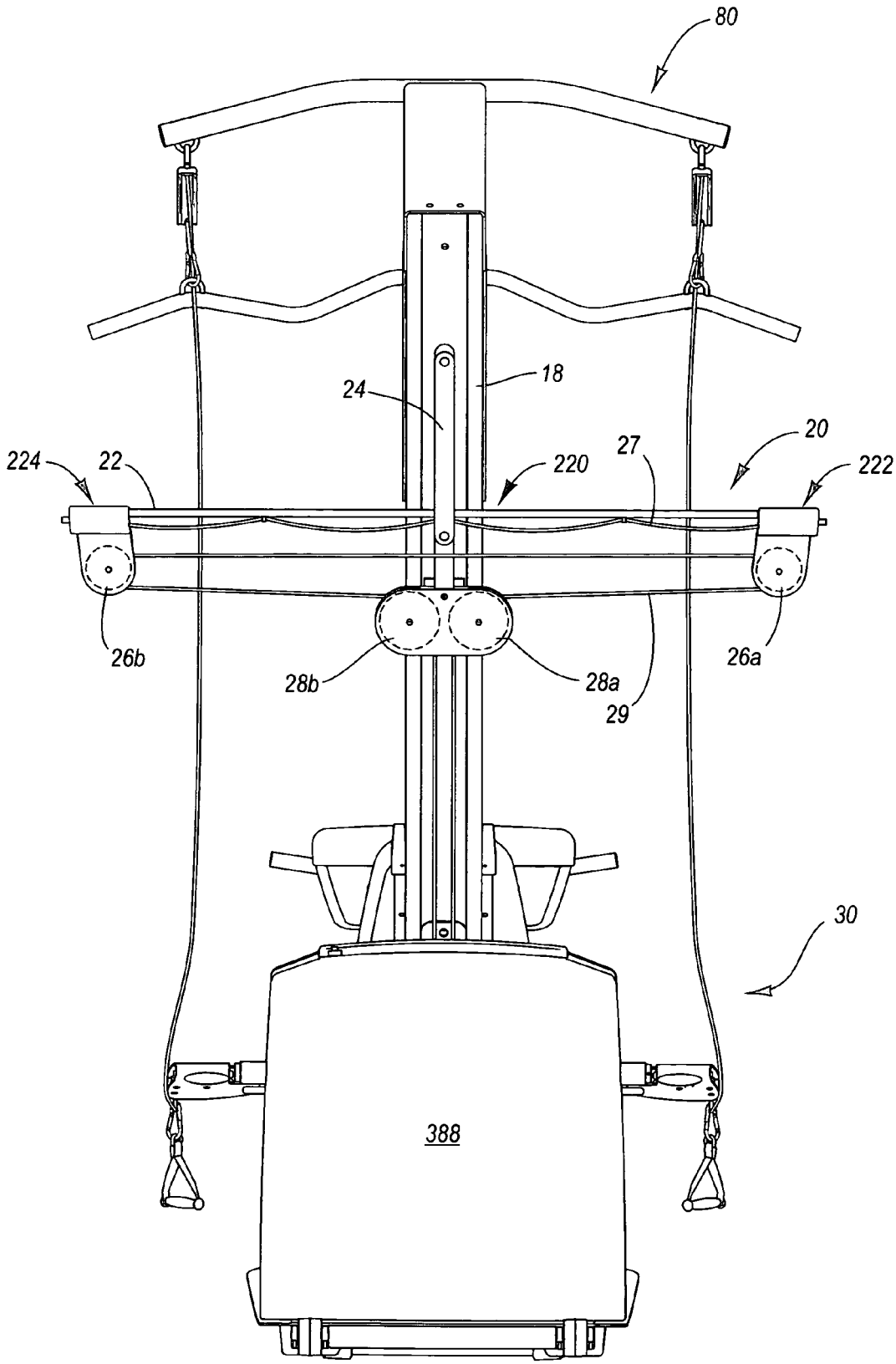
FIG. 3 is a rear view illustrating the resistance assembly of the exercise machine of FIG. 1 according to one aspect of the present invention.

FIG. 3 shows a rear view of exercise apparatus 1 illustrating resistance assembly 20 in greater detail according to one aspect of the present invention. In the illustrated embodiment, resistance assembly 20 includes a resilient elongate rod 22, a guide 24, pulleys 26*a, b*, a retention cable 27, and resistance cable 29. Resilient elongate rod 22 is configured to provide resistance for use in exercise. Resilient elongate rod 22 is positioned proximal to upright component support member 18 such that no portion of resilient elongate rod 22 is fixed in relation to support frame 10 or upright support member 18. This allows resilient elongate rod 22 to move relative to other portions of exercise apparatus 1 in a flexible and desired manner.

Guide 24 is positioned relative to resilient elongate rod 22 so as to maintain movement of resilient elongate rod 22 in a predictable and orderly fashion. Guide 24 is positioned adjacent at least one side of the resilient elongate rod 22. The positioning of guide 24 minimizes inadvertent movement of resilient elongate rod 22 closer to, or further from, upright component support member 18. A variety of types and configurations of guides can be utilized without departing from the scope and spirit of the present invention. For example, in the illustrated embodiment guide 24 includes a first guide member positioned adjacent one side of the single resilient elongate rod and a second guide member positioned adjacent the opposite side of the single resilient elongate rod. The combination of the first and second guide member maintains smooth and consistent movement of the single resilient elongate rod when the single resilient elongate rod flexes. In one embodiment, the first and second guide member comprise a guide mechanism. In another embodiment, more than two guide members are utilized with the single resilient elongate rod to maintain smooth and consistent movement of the single resilient elongate rod.

Guide 24 includes at least one riser coupler 240 (see FIG. 4A) that spaces guide 24 apart from upright support member 18. The desired displacement between guide member 24 and upright component support member 18 can substantially correspond with the width of resilient elongate rod 22.

Pulleys 26*a, b* are disposed at the ends of resilient elongate rod 22. Pulleys 28*a, b* are positioned below and toward the middle portion of resilient elongate rod 22. Pulleys 26*a, b* cooperate with pulleys 28*a, b*, which are affixed to upright component support member 18 and are operably linked to rod 22 utilizing resistance cable 29.

A retention cable 27 is coupled to one or more portions of the resilient elongate rod. In the illustrated embodiment, retention cable 27 is coupled to first end 222, center portion 220, and second end 224 of resilient elongate rod 22. Retention cable 27 provides reinforcement to resilient elongate rod 22 including maintaining the positioning of pulleys 26*a, b*.

Resistance cable 29 provides a mechanism for conveying resistance from resilient elongate rod 22 to variable resistance system 30. More specifically, variable resistance system 30 manipulates the fixed resistance provided by flexing of resilient elongate rod 22 by way of resistance cable 29, pulleys 26*a, b* and 28*a, b* to convey a variable resistance to the user when the user undertakes an exercise repetition. As will be appreciated by those skilled in the art, resistance assembly 20 can be coupled to other components of exercise machine 1 utilizing a variety of mechanisms and in a variety of manners without departing from the scope and spirit of the present invention.

Figure 4A:
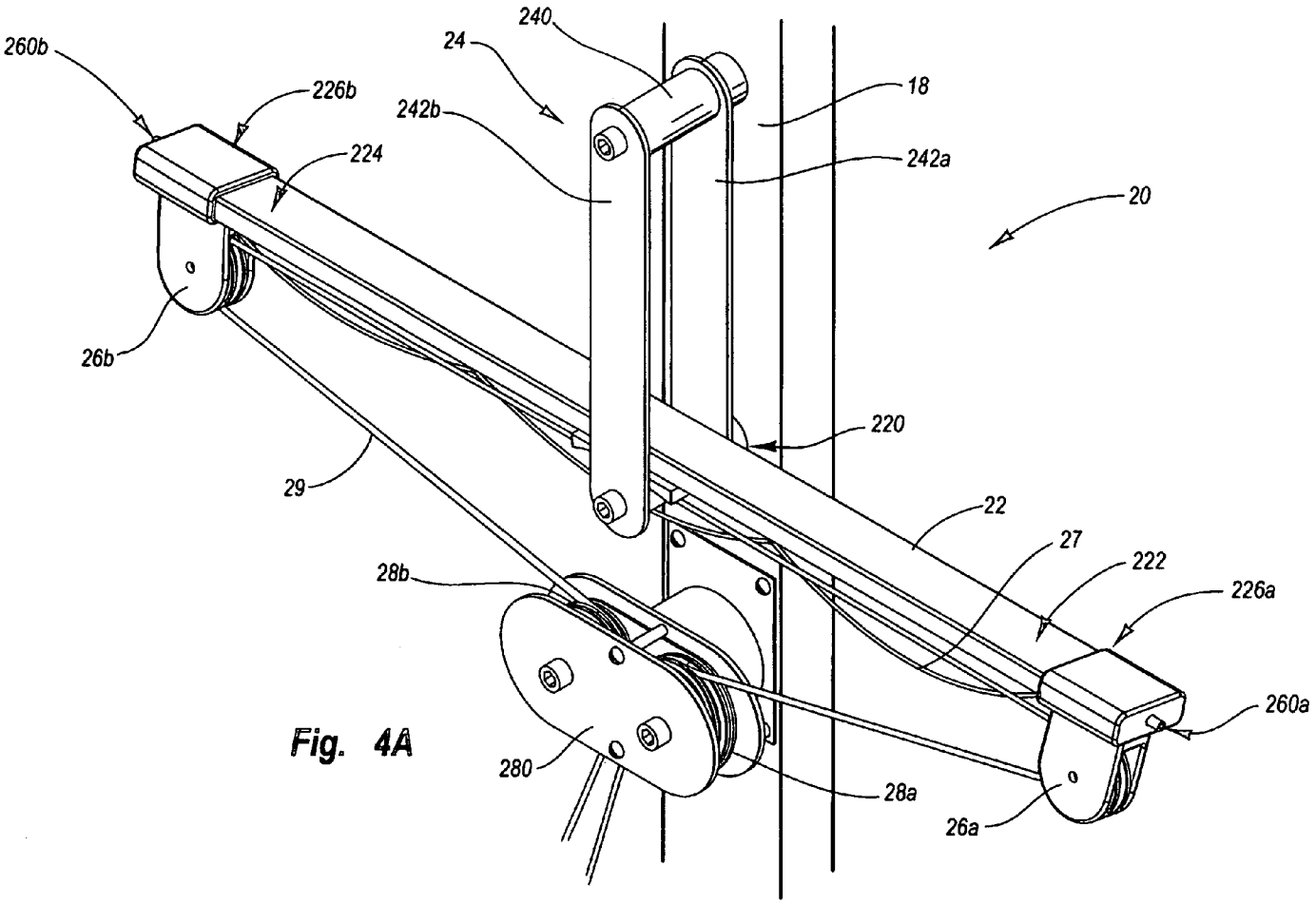
FIG. 4A is a perspective view of the resistance assembly of the exercise machine of FIG. 1 having a guide with first and second guide members positioned on opposing sides of the single resilient elongate rod according to one embodiment of the present invention.

FIG. 4A is a perspective view of resistance assembly 20 illustrating resilient elongate rod 22 in a relaxed position. In the illustrated embodiment, resilient elongate rod 22 includes a center portion 220, a first end 222, and a second end 224. When resilient elongate rod 22 is in a relaxed position, center portion 220 is positioned at substantially the same elevation as first end 222 and second end 224.

Guide 24 allows for flexing of resilient elongate rod 22. Guide 24 includes a riser coupler 240, a first guide member 242*a*, and a second guide member 242*b*. Riser coupler 240 couples guide 24 to upright component support member 18. Riser coupler 240 also provides spacing between first guide member 242*a* and second guide member 242*b*. In the illustrated embodiment, the length of riser coupler 240 is slightly greater than the width of resilient elongate rod 22.

First guide member 242*a* and second guide member 242*b* are positioned on alternative sides of resilient elongate rod 22. The positioning of first guide member 242*a* and second guide member 242*b* maintains smooth and consistent movement of resilient elongate rod 22 as resilient elongate rod flexes 22. For example, first guide member 242*a* minimizes movement in the direction of upright component support member 18. Second guide member 242*b* minimizes movement away from upright component support member 18 (see FIG. 2.) The combination of first guide member 242*a* and second guide member 242*b* maintains the position of resilient elongate rod in a given perpendicular plane when resilient elongate rod 22 flexes during an exercise routine.

A variety of types and configurations of resilient elongate rods can be utilized without departing from the scope and spirit of the present invention. In one embodiment of the present invention, a guide member is positioned adjacent at least one side of the resilient elongate rod. In another embodiment, a plurality of guide members are utilized with the single resilient elongate rod to maintain smooth and consistent movement of the single resilient elongate rod. In yet another embodiment, a first guide member is positioned adjacent one side of the single resilient elongate rod and a second guide member is positioned adjacent the opposite side of the single resilient elongate rod.

Figure 4B:
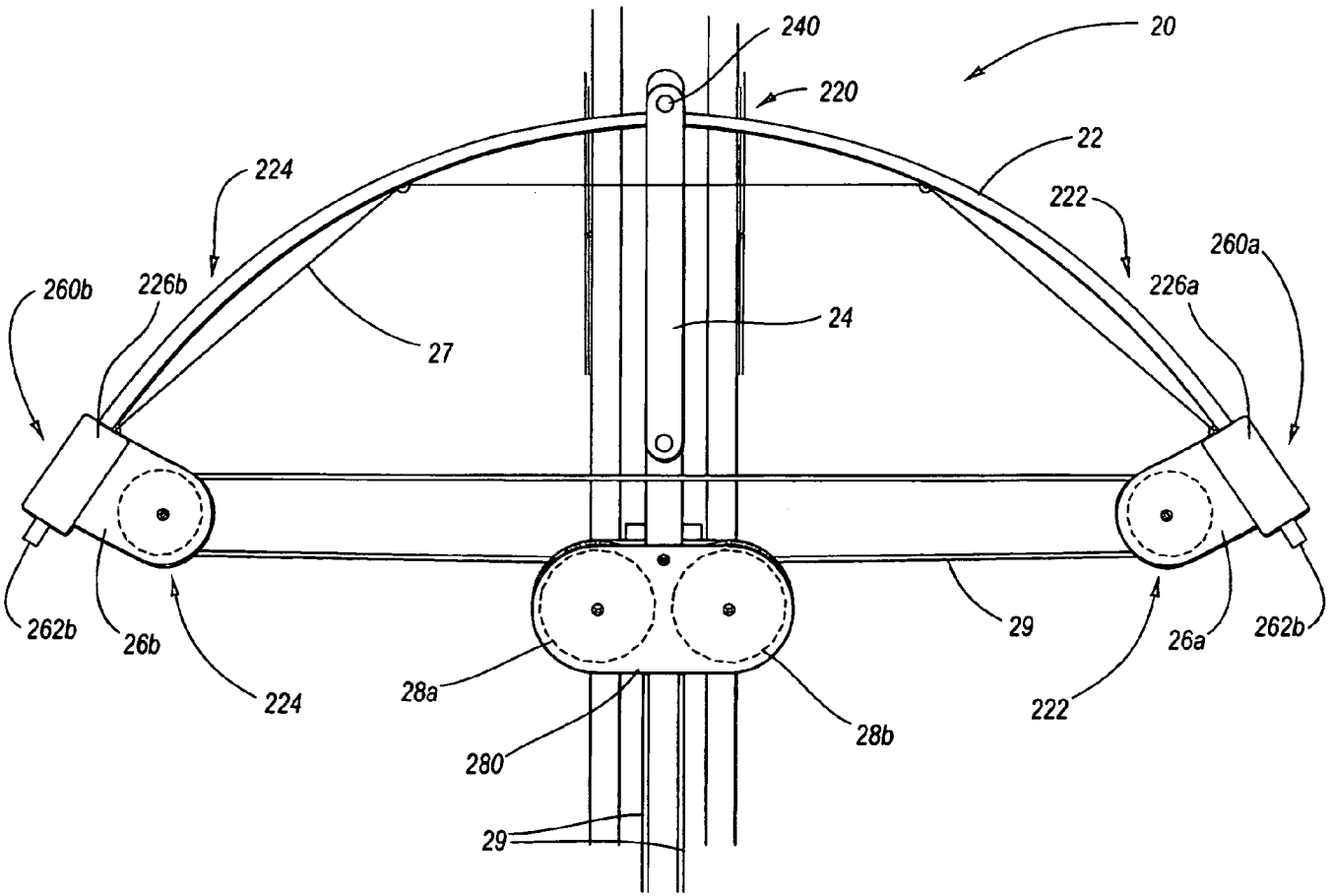
FIG. 4B is a perspective view of the resistance assembly of the exercise machine of FIG. 1 in a flexed position according to one aspect of the present invention.

FIG. 4B illustrates resilient elongate rod 22 in a flexed configuration. During exercise, a force is exerted on resistance cable 29 at a point below pulleys 28*a, b* in connection with variable resistance system 30. The force exerted on resistance cable 29 is conveyed to pulleys 28*a, b*. This causes shortening of the portion of resistance cable 29 above pulleys 28*a, b*. Shortening of the resistance cable 29 causes pulleys 26*a, b* to be pulled toward each other. As pulleys 26*a, b* are pulled toward each other, center portion 220 of resilient elongate rod 22 moves toward riser coupler 240 and rod 22 begins to flex.

Guide 24 prevents excessive lateral displacement of resilient elongate rod 22 when resilient elongate rod 22 flexes. No portion of resilient elongate rod 22 is fixed in relation to support frame 10. As a result, first end 222, second end 224, and center portion 220 all move relative to one another and to other components of exercise machine 1 during exercise. In the illustrated embodiment retention cable 27 is coupled to resilient elongate rod 22 at a plurality of positions along the length of resilient elongate rod 22. This allows retention cable 27 to largely move in conformity to resilient elongate rod 22 during flexing of resilient elongate rod 22.

As will be appreciated by those skilled in the art, a variety of types and configurations of resistance assemblies can be utilized without departing from the scope and spirit of the present invention. For example, in one embodiment, the single resilient elongate rod is comprised of a plurality of resilient elongate rods that can be utilized cooperatively. In another embodiment, a plurality of resilient elongate rods are utilized to provide a variable amount of resistance. In another embodiment, two separate cables are coupled to each end of the single resilient elongate rod. In the illustrated embodiment, the position of pulleys 26*a, b* is fixed. The amount of tension of resistance cable 29 relative to pulleys 26*a, b* is configured such that length adjustment mechanisms are not necessary to properly operate pulleys 26*a, b*.

Figure 5:
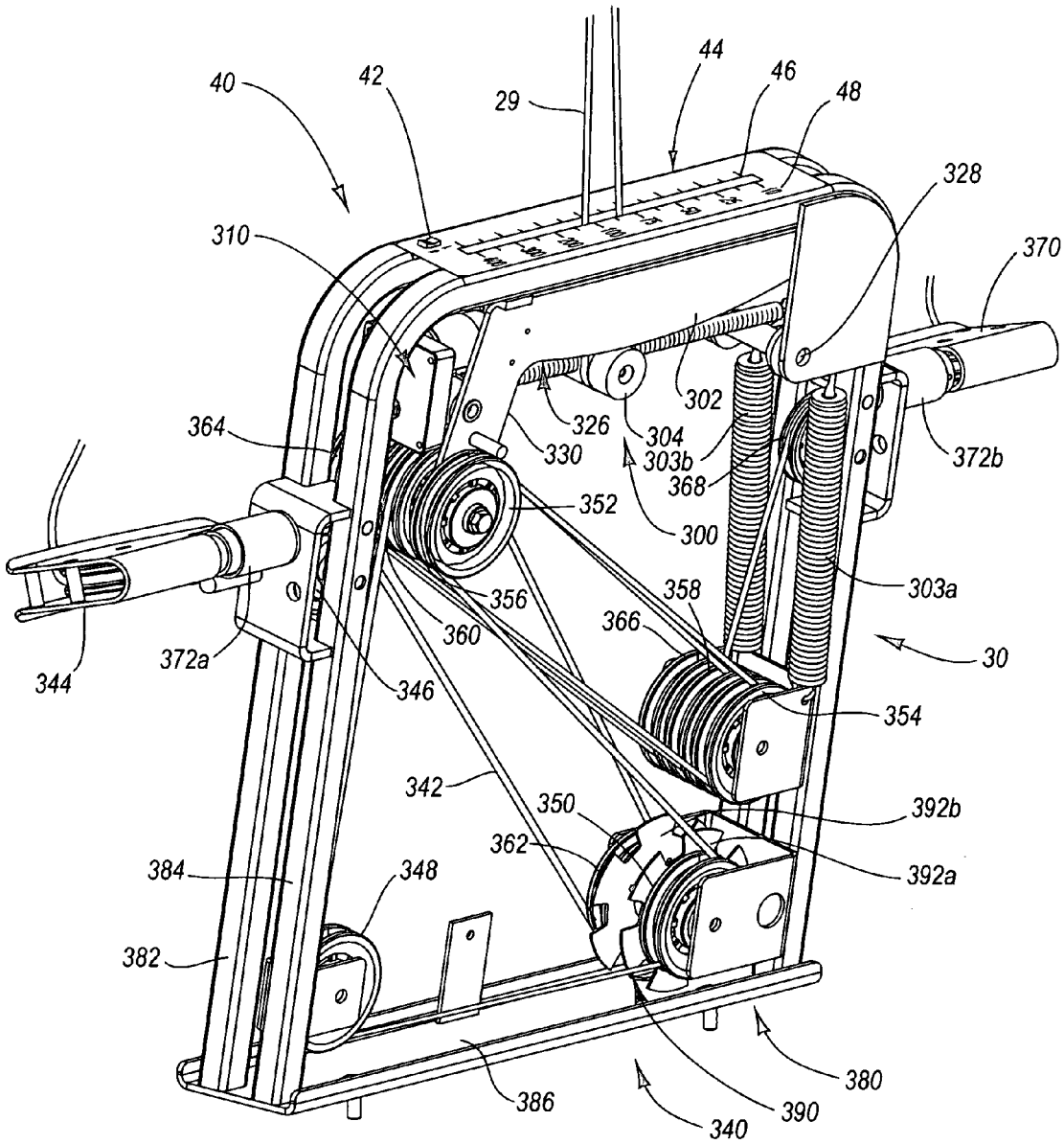
FIG. 5 shows the variable resistance system having a weight selector controller (e.g. bi-directional controller 42) of the exercise machine of FIG. 1 according to one aspect of the present invention.

FIG. 5 illustrates a weight selector mechanism of the exercise machine comprising a variable resistance system 30 and an electronic weight selector controller 40. Variable resistance system 30 is illustrated according to one embodiment of the present invention. Variable resistance system 30 is configured to utilize resistance from one or more resilient elongate rods to provide a variable amount of resistance for use in exercise. In the illustrated embodiment, variable resistance system 30 includes an automatic resistance adjustment mechanism 300, a cable and pulley system 340, a housing 380, and a repetition sensor 390.

Housing 380 is coupled to upright component support member 18 (see FIG. 2). Housing 380 provides a support structure on which other components of variable resistance system 30 can be mounted. Housing 380 includes a first frame member 382, a second frame member 384, a frame base 386, and a casing 388 (see FIG. 3). First frame member 382 and second frame member 384 provide structural support and protection to other components of variable resistance system 30. First and second frame members 382 and 384 provide sufficient strength to withstand forces exerted on automatic resistance adjustment mechanism 300 and pulley system 340.

Frame base 386 is coupled to the bottom of first and second frame members 382 and 384. Frame base 386 is also adapted to be coupled to upright component support member 18 and support base 16. A casing 388, as shown in FIG. 3, is adapted to be positioned over first frame member 382, second frame member 384, frame base member 386, and other components of variable resistance system 30. Casing 388 provides a decorative covering while also protecting the internal components of variable resistance system 30 from damage. Additionally, casing 388 prevents a user from interfering with operation of cable and pulley system 340.

Automatic resistance adjustment mechanism 300 is pivotally mounted to housing 380. In the illustrated embodiment, automatic resistance adjustment mechanism 300 is coupled to first frame member 382 and second frame member 384. Automatic resistance adjustment mechanism 300 cooperatively interacts with weight selector controller 40 to allow a user to select an amount of resistance to be utilized during exercise. Automatic resistance adjustment mechanism 300 automatically changes the amount of resistance provided by variable resistance system 30 without requiring the user to manually adjust components of exercise apparatus 1.

In the illustrated embodiment, automatic resistance adjustment mechanism 300 includes a lever arm 302, a lever arm length regulator 304, and a lead screw motor assembly 310. Lever arm 302 cooperatively interacts with cable and pulley system 340 to regulate the amount of resistance required to displace resistance cable 29 and by extension resilient elongate rod 22. Lever arm length regulator 304 is linked to resistance assembly resistance cable 29 allowing flexing of resilient elongate rod 22 (see FIG. 1). Lever arm length regulator 304 changes the effective length of lever arm 302 to provide a greater or lesser amount of mechanical advantage. By changing the amount of mechanical advantage provided by lever arm 302, a greater or lesser amount of resistance is required to flex resilient elongate rod 22. Lever arm length regular 304 is moved laterally by means of lead screw motor assembly 310. Lead screw motor assembly 310 is coupled to lever arm 302 and lever arm length regular 304. When a user selects a change in the amount of resistance with which to exercise utilizing electronic weight selector controller 40, lead screw motor assembly automatically changes the position of lever arm length regulator 304 to provide the desired amount of leverage benefit and thereby the desired amount of resistance for use during exercise.

Lever arm length regulator 304 engages a curved surface 326 of lever arm 302. Curved surface 326 is configured to maintain a constant tension on resistance assembly resistance cable 29 notwithstanding the lateral position of lever arm length regulator 304 along lever arm 302. A pivot 328 provides a pivot point for lever arm 302. Additionally, pivot 328 provides a point of coupling between lever arm 302 and housing 380.

An angle portion 330 of lever arm 302 positions the pulleys coupled to lever arm 302 at a desired displacement relative to other pulleys of the cable and pulley system 340. This allows lever arm 302 to provide a desired effective lever arm length and predetermined mechanical advantage. The operation of lever arm 302 and other components of lead screw motor assembly 310 will be described in greater detail with reference to FIGS. 7A, 7B, 7C, and 7D.

There are also shown first and second bias springs 303*a, b* utilized in connection with lever arm 302. Bias springs 303*a, b* provide a minimum amount of resistance when lever arm length regulator 304 is positioned at a displacement adjacent pivot 328. Bias springs 303*a, b* provides an amount of resistance in addition to that provided by resilient elongate rod 22. This can be helpful where the mechanical advantage resulting from the positioning of the lever arm length regulator 304 reduces the amount of resistance provided by resilient elongate rod 22 beyond a desired amount.

Cable and pulley system 340 is coupled to several components of variable resistance system 30 including lever arm 302 and housing 380. Cable and pulley system 340 provides a compound pulley system to minimize the amount of force required to flex resilient elongate rod 22. In the illustrated embodiment, cable and pulley system 340 includes a cable 342, pulleys 344, 346, 348, 350, 352, 354, 356, 358, 360, 362, 364, 366, 368, 370 and rotatable couplers 372*a,b*.

The first and second ends of cable 342 are utilized by a user during exercise routines. The ends of cable 342 can be coupled to hand grips of the exercise machine, or other mechanisms allowing a user to exert a force on cable 342. The following is a discussion of an illustrative routing of cable 342 through pulleys 344, 346, 348, 350, 352, 354, 356, 358, 360, 362, 364, 366, 368, 370 and is not intended to restrict the scope and spirit of the present invention. Cable 342 is routed through pulleys 344, 346, 348, 350, 352, 354, 356, 358, 360, 362, 364, 366, 368, 370 to maintain smooth and efficient movement of cable 342, as well as to provide a compounding effect on the amount of resistance exerted by the user. A first end of cable 342 extends from pulley 344. Cable 342 is then routed from pulley 344 through pulley 346 and around pulley 348. From pulley 348, cable 342 is routed through pulley 350, around pulley 352, to pulley 354. From pulley 354 cable 342 is routed back to pulley 356, around pulley 358 to pulley 360. From pulley 360 cable is routed around pulley 362, up and around pulley 364, and down around pulley 366. From pulley 366 cable 342 is routed around pulley 368 and finally around pulley 370 from which the second end of cable 342 extends.

The configuration of cable 342 and its juxtaposition with pulleys 344, 346, 348, 350, 352, 354, 356, 358, 360, 362, 364, 366, 368, 370 compounds the force exerted by the user on the cable and pulley system while also ensuring smooth and efficient operation of the movement of the cable. As will be appreciated by those skilled in the art, a variety of types and configurations of routing cable 342 through pulleys 344, 346, 348, 350, 352, 354, 356, 358, 360, 362, 364, 366, 368, 370 can be utilized without departing from the scope and spirit of the present invention.

During an exercise routine, the user exerts a force on one or both ends of cable 342. As one or both ends of cable 342 are displaced, the end of lever arm 302 corresponding with angle portion 330 and cables 352, 356, 360 and 364 move toward pulleys 354, 358, and 366. Resistance from the ends of resilient elongate rod 22 is conveyed to lever arm 302 by resistance cable 29 of resistance assembly 20. Movement of the end of lever arm 302 corresponding with angel portion 330 results in displacement of resistance assembly resistance cable 29. Movement of resistance cable 29 results in flexing of resilient elongate rod providing resistance for use in exercise.

As previously discussed, variable resistance system 30 operates in connection with weight selector controller 40 to move lever arm length regulator 304 to change the effective length of lever arm 302 thus changing the amount of resistance experienced by the user when moving the ends of cable 342. By providing a quick and efficient mechanism for changing the amount of resistance utilized during exercise, exercise apparatus 1 provides an efficient and user friendly mechanism for conducting exercise routines.

In the illustrated embodiment, a repetition sensor 390 is shown. In the illustrated embodiment, the repetition sensor 390 comprises a magnetic sensor or optical sensor that includes first and second disks 392*a, b*. The first and second disks 392*a, b* include offset voids that can be detected to monitor the presence and direction of movement of the pulleys 350 and 362 to which the disks are connected. Exemplary repetition sensors are disclosed in greater detail in commonly-assigned U.S. patent application Ser. No. 10/916,687 of Kowallis, et al., filed on Aug. 11, 2004 via U.S. Express Mail Number EV 432 689 389 US, entitled "REPETITION SENSOR IN EXERCISE EQUIPMENT," the entire contents of which are incorporated herein by reference. As will be appreciated by those skilled in the art, a variety of types and configurations of sensors can be utilized without departing from the scope of the present invention. For example, in one embodiment the sensor includes a light sensor. In an alternative embodiment, the sensor detects movement of the lever arm.

FIG. 5 also illustrates a weight selector controller 40 according to one embodiment of the present invention. In the illustrated embodiment, weight selector controller 40 is positioned on the housing of automatic resistance adjustment mechanism 300. Weight selector controller 40 includes a bi-directional controller 42 and at least one indicium 44. Bi-directional controller 42 allows the user to control the amount of resistance provided by resilient elongate rod 22 in combination with variable resistance system 20. When a user actuates bi-directional controller 42 in a first direction, the amount of resistance is increased. When the user actuates the bi-directional controller 42 in the opposite direction, the amount of resistance is decreased. In the illustrated embodiment, the bi-directional controller comprises a two-way switch.

The present invention is not limited to the use of a bi-directional controller to adjust the amount of resistance provided by the resilient elongate rod in combination with the variable resistance system. For example, in one embodiment, a digital controller is utilized to allow the user to input a desired amount of resistance to be provided. In another embodiment, a mechanism is provided that allows the user to manually adjust the amount of resistance provided. In another embodiment, a solid state controller that allows the user to adjust the amount of resistance is provided.

The at least one indicium 44 illustrated allows the user to view the amount of resistance being provided by the resilient elongate rod 22 in combination with the variable resistance system. In the illustrated embodiment, the at least one indicium 44 includes a plurality of indicator lines 46 and a plurality of resistance numerals 48. The plurality of indicator lines 46 are positioned adjacent a slot accommodating, and allowing for movement, of resistance cable 29 as the cable is displaced when the position of lever arm length regulator 304 is changed. The juxtaposition of the plurality of indicator lines 46 relative to resistance cable 29 allows the user to quickly ascertain the amount of resistance provided at given positions of the cable.

The plurality of resistance numerals are associated with indicator lines 46 and depict the amount of resistance provided when the cable is positioned at the indicator lines. For example, when resistance cable 29 is positioned adjacent the indicator line associated with a numeral "300," 300 pounds of resistance is provided by the combination of the single resilient elongate rod 22 and variable resistance system 30. This allows the user to clearly monitor the amount and direction of change in resistance when operating bi-directional controller 42. In the illustrated embodiment, indicator lines are positioned on either side of the slot accommodating resistance cable 29.

As will be appreciated by those skilled in the art, a variety of types and configurations of indicia can be utilized without departing from the scope and spirit of the present invention. For example, in one embodiment, a digital readout is provided to indicate the amount, and changes in the amount, of resistance. In another embodiment, an analog display is utilized to indicate the amount, and changes in the amount, of resistance. In another embodiment, one or a plurality of light emitting diodes (LEDs) are provided to indicate the amount, and changes in the amount of resistance. In another embodiment, the at least one indicium is provide at a location other than on the housing.

Figure 6:
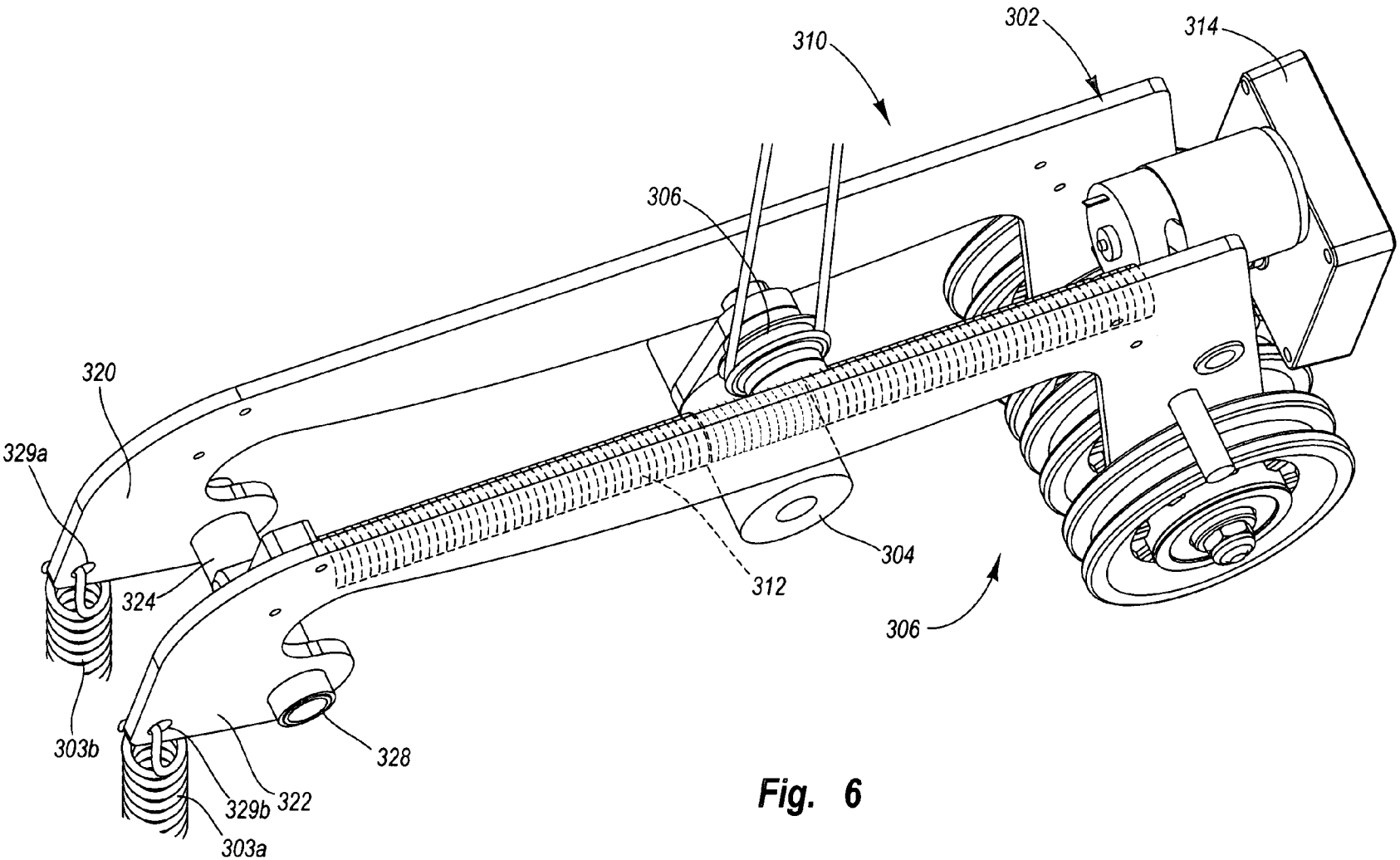
FIG. 6 is a top perspective view of the automatic resistance adjustment mechanism of the exercise machine of FIG. 1 according to one aspect of the present invention.

FIG. 6 is a top perspective view of lever arm 302 illustrating lead screw motor assembly 310 in greater detail. The juxtaposition of a first bias spring 303*a* and a second bias spring 303*b* relative to pivot 328 is shown. In the illustrated embodiment, lead screw motor assembly 310 includes a lead screw 312, and a lead screw motor 314. Lead screw 312 is threadably coupled to lever arm length regulator 304. Lead screw 312 is rotated utilizing lead screw motor 314. When lead screw 312 is rotated in one direction, lever arm length regulator is cooperatively engaged by the threads of the lead screw 312 and moves in the direction of pivot 328. When lead screw motor 314 is turned in the opposite direction, lever arm length regulator 304 is cooperatively engaged by the threads of lead screw 312 and moves in the direction of lead screw motor 314.

Lead screw motor 314 is coupled to lever arm 302. Lead screw motor 314 provides the rotational force necessary to cause rotation of lead screw 312 and thereby lateral movement of lever arm length regulator 304. According to one aspect of the present invention, lead screw motor 314 includes a DC motor with an attached gear box. As will be appreciated by those skilled in the art, a variety of types and configurations of motors can be utilized without departing from the scope and spirit of the present invention.

In the illustrated embodiment, lever arm 302 includes a first member 320, a second member 322, a coupler 324, a first bias spring coupling 329*a*, and a second bias spring coupling 329*b*. First and second members 320 and 322 both include a curved surface and an angled portion. First and second member 320 and 322 are connected at one end by coupler 324. The curved surface portions of first member and second member 320 and 322 engage lever arm length regulator 304. Lead screw 312 is positioned between first member 320 and second member 322.

In the illustrated embodiment a first and second bias spring 303*a, b* are coupled to first and second members 320 and 322 at first and second bias spring couplings 329*a, b*. The first and second bias spring couplings 329*a, b* are positioned on the side of pivot 328 opposite the four pulleys coupled to the end of lever arm 302. This allows bias springs 303*a, b* to provide additional resistance to that provided by single resilient elongate rod 22. The additional resistance can be utilized where the effective length of the lever arm minimizes the amount of resistance provided by single resilient elongate rod 22.

As will be appreciated by those skilled in the art, a variety of types and configurations of lever arms and bias springs can be utilized without departing from the scope and spirit of the present invention. For example, in one embodiment, the lever arm includes a single lever member adapted to accommodate a lead screw and lever arm regulator. In an alternative embodiment, the actual length of the lever arm is adapted to be adjusted instead of utilizing a lever arm length regulator. In one embodiment, a single bias spring is attached to the end of the lever arm. In another embodiment, a source of resistance is provided other than the single resilient elongate rod. For example, in one embodiment, a resilient band is connected to the lever arm. In another embodiment, a resilient compressible foam rubber or other resilient member that provides resistance in compression is provided. In another embodiment, the source of resistance comprises a suspended weight. In another embodiment, the source of resistance is coupled to the lever arm on the same side as the four pulleys coupled to the end of the lever arm.

In the illustrated embodiment, it can be seen that lever arm length regulator 304 is coupled to a pulley 306. Pulley 306 accommodates resistance cable 29. When the end of lever arm 302 is displaced, the portion of resistance cable 29 positioned in pulley 306 is displaced during movement of lever arm 302.

Figure 7A:
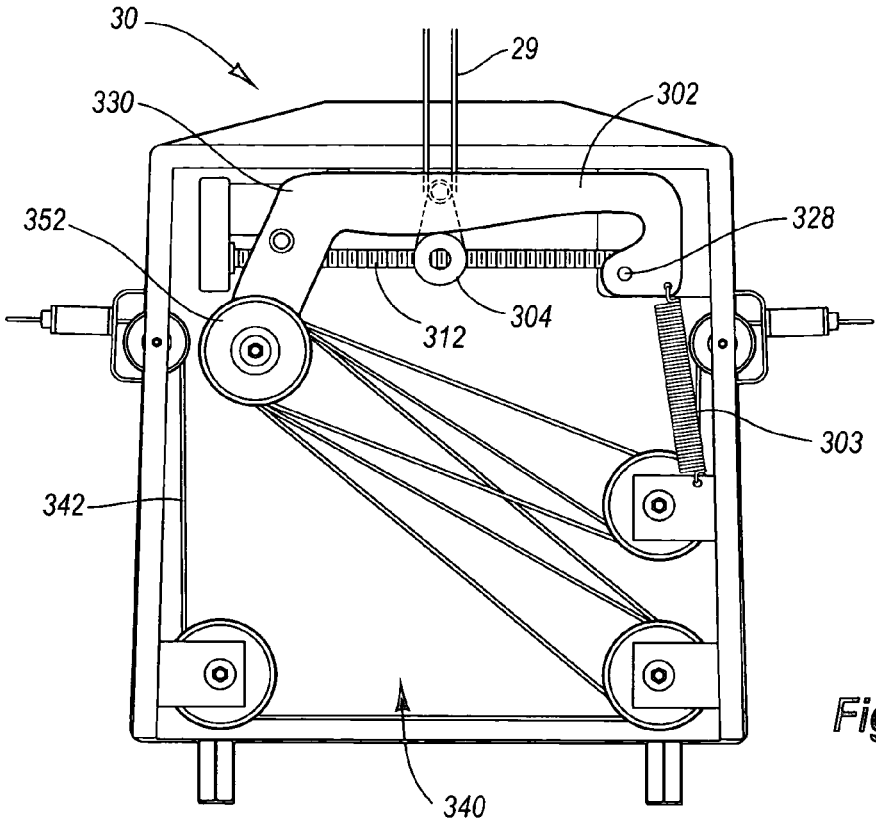
FIG. 7A illustrates the automatic resistance adjustment mechanism of the exercise machine of FIG. 1 in which the lever arm is in a first position.

FIG. 7A illustrates a variable resistance system 30 with lever arm length regulator 304 in an intermediate position. In the illustrated embodiment, lever arm 302 is in a relaxed position causing little or no displacement of resistance cable 29. In the relaxed position, bias spring 303 is in a non-stretched configuration. The current position of lever arm 302 is achieved when insufficient resistance is exerted on a cable and pulley system 340 to cause movement of the end of lever arm 302 corresponding with angle portion 330.

Figure 7B:
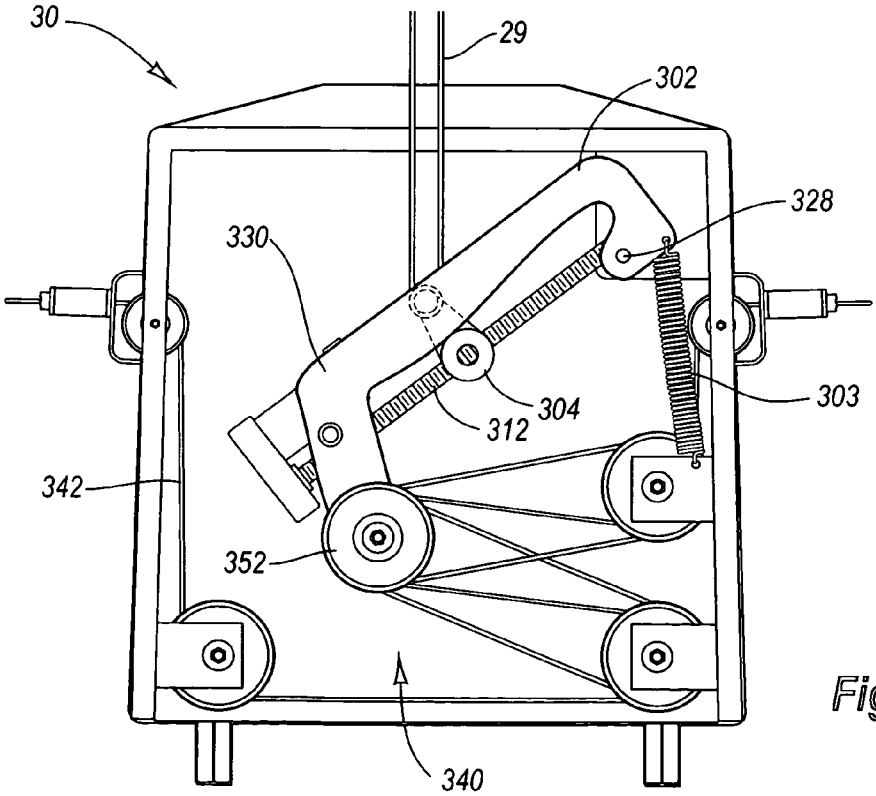
FIG. 7B illustrates the automatic resistance adjustment mechanism of the exercise machine of FIG. 1, in which the lever arm is in a second position.

FIG. 7B shows a lever arm 302 in a displaced configuration. The illustrated configuration of lever arm 302 is achieved when sufficient force is exerted on the pulleys coupled to angle portion 330 of lever arm 302. The displacement of the end of lever arm 202 corresponding with angle portion 330 results in movement of lever arm length regulator 304 and resistance assembly resistance cable 29. Movement of resistance cable 29 results in flexing of resilient elongate rod 22. Movement of resistance cable 29 causes stretching of bias spring 303 increasing the amount of resistance experienced by the user over the resistance provided by the resilient elongate rod. As previously discussed, the configuration of lever arm 302 results in movement of lever arm about pivot 328.

Figure 7C:
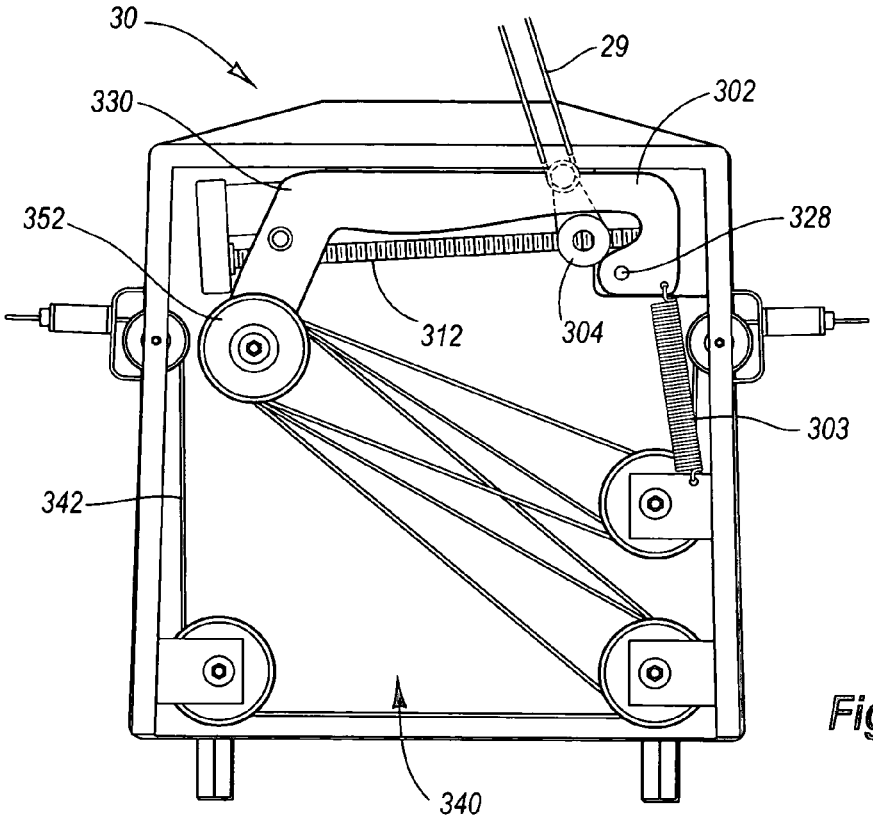
FIG. 7C illustrates the automatic weight resistance adjustment mechanism of the exercise machine of FIG. 1 in which the lever arm length regulator is in a first position.

FIG. 7C illustrates lever arm length regulator 304 at a lateral position adjacent pivot 328. In the illustrated position, lever arm length regulator 304 is at or near its greatest lateral displacement adjacent pivot 328. The illustrated position of lever arm length regulator 304 also corresponds with the smallest amount of resistance being experienced by the user. According to one embodiment of the present invention, a weight of less than 10 pounds is provided when lever arm length regulator 304 is in the illustrated position.

The actual resistance experienced by the user is the result of a variety of factors including the length of the lever arm and the configuration of the cable and pulley system 340. In this position, the mechanical advantage provided by lever arm 302 is at its greatest. As a result, displacement of cable 342 produces a large amount of movement of the end of lever arm 302 corresponding with angle portion 330. While a large amount of movement of lever arm 302 is experienced, displacement of lever arm length regulator 304 and resistance cable 29 is minimal.

The compounding effect provided by the configuration of cable and pulley system 340 results in a large amount of displacement of cable 342 of the cable and pulley system but a smaller amount of displacement of lever arm length regulator 304. This compound pulley effect allows the user to obtain a large amount of extension of the ends of cable 342 for a small amount of flexing of resilient elongate rod 22. The combination of the compounding effect of cable and pulley system 340 and mechanical advantage of lever arm 302 results in a large amount of overall mechanical advantage. Thus, a small amount of effort is required to flex resilient elongate rod 22.

In the illustrated position, bias spring 303 provides additional resistance over the amount of resistance provided by the single resilient elongate rod. This can be useful where little or no resistance is provided by the single resilient elongate rod due to the mechanical advantage provided by the positioning of lever arm length regulator.

As will be appreciated by those skilled in the art, a variety of types and configurations of resilient resistance members can be utilized without departing from the scope and spirit of the present invention. For example in one embodiment, the resilient resistance member provides a counteracting force to decrease the total resistance provided by variable resistance system 30 and resistance assembly 20. In another embodiment, resilient resistance member comprises a resilient band. Exemplary lever arms and resistance components are disclosed in greater detail in commonly-assigned U.S. Pat. No. 6,685,607 of Olson, filed on Jan. 10, 2003, entitled "EXERCISE DEVICE WITH RESISTANCE MECHANISM HAVING A PIVOTING ARM AND A RESISTANCE MEMBER" the entire contents of which are incorporated herein by reference.

Figure 7D:
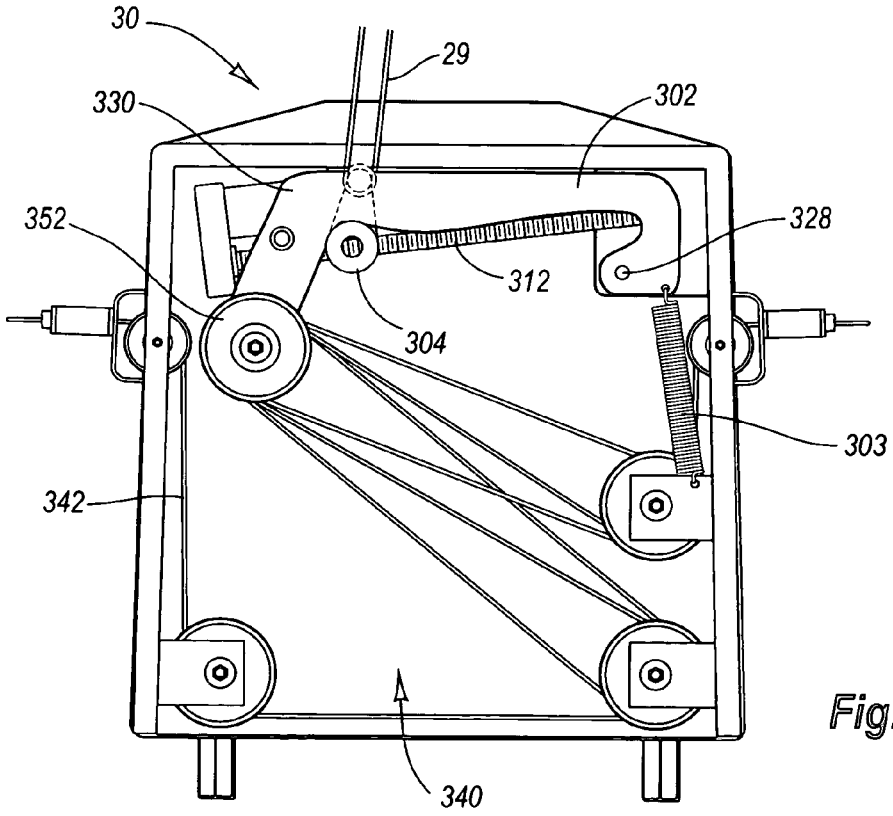
FIG. 7D illustrates the automatic resistance adjustment mechanism of the exercise machine of FIG. 1 in which the lever arm length regulator is in a second position.

FIG. 7D illustrates a variable resistance system 30 with a lever arm length regulator 304 positioned adjacent the portion of lever arm 302 corresponding with angle portion 330. The illustrated position of lever arm length regulator 304 results in a minimal mechanical advantage being provided by lever arm 302 based on the small effective length of lever arm 302. When the user exerts a force on the ends of cable 342, displacement of the end of lever arm 302 corresponding with angle portion 330 is effectively the same displacement of lever arm length regulator 304. As a result, displacement of the end of lever arm 302 corresponding with angle portion 330 results in a large amount of displacement of resistance cable 29. The large amount of displacement of resistance cable 29 and the small amount of mechanical advantage provided by lever arm 302 results in a large amount of resistance being required to flex resilient elongate member 22.

According to one embodiment of the present invention, the amount of resistance experienced when lever arm length regulator 304 is in the illustrated position is approximately 440 pounds of resistance. In an alternative embodiment, the amount of the resistance experienced is approximately 340 pounds. As will be appreciated by those skilled in the art, a variety of types and configurations of variable resistance systems 30 can result in a variety of types and amounts of resistance experienced by the user without departing from the scope and spirit of the present invention.

Figure 8:
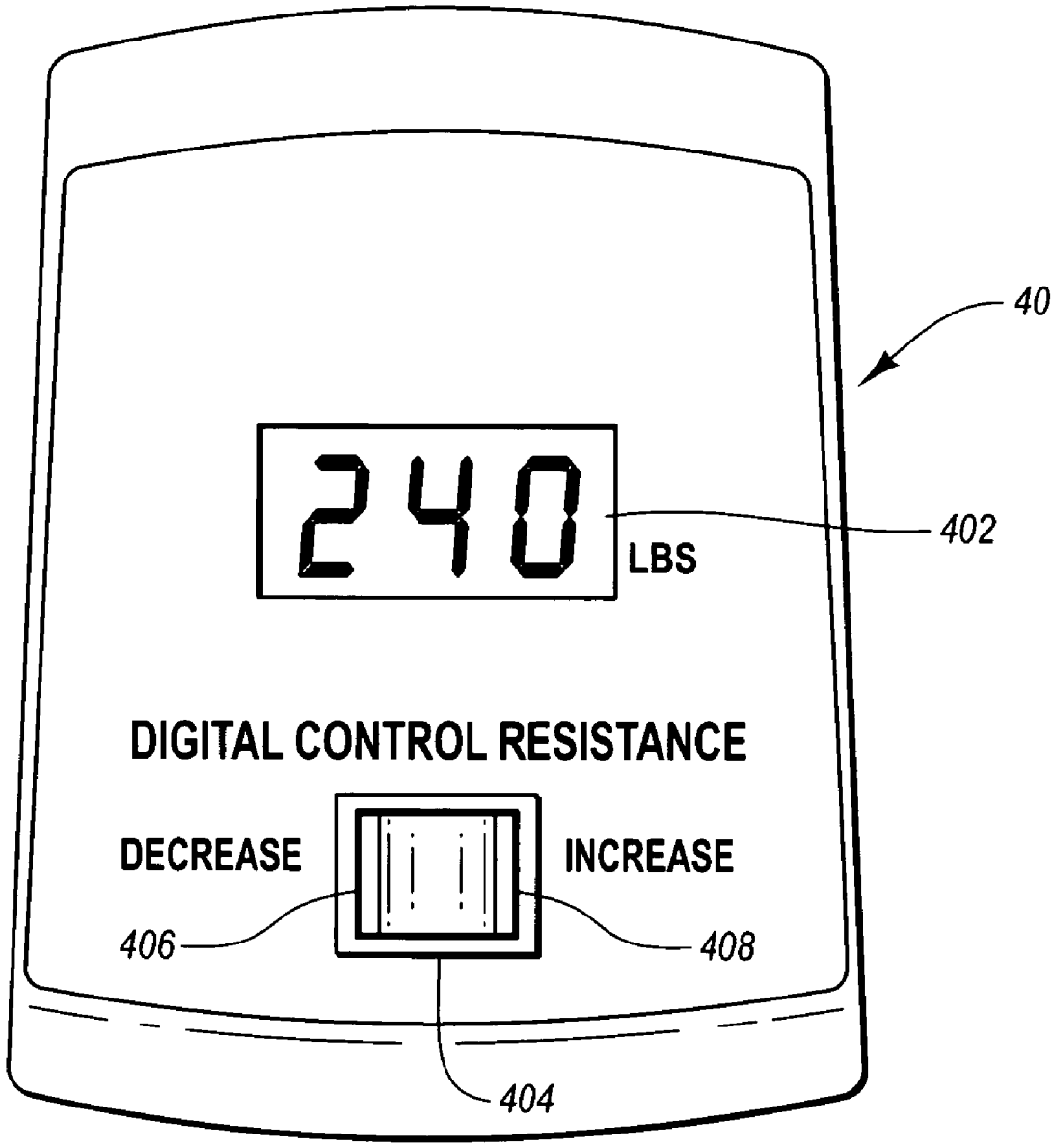
FIG. 8 is a front view of an electronic weight selector controller according to one embodiment of the present invention.
Figure 4B:
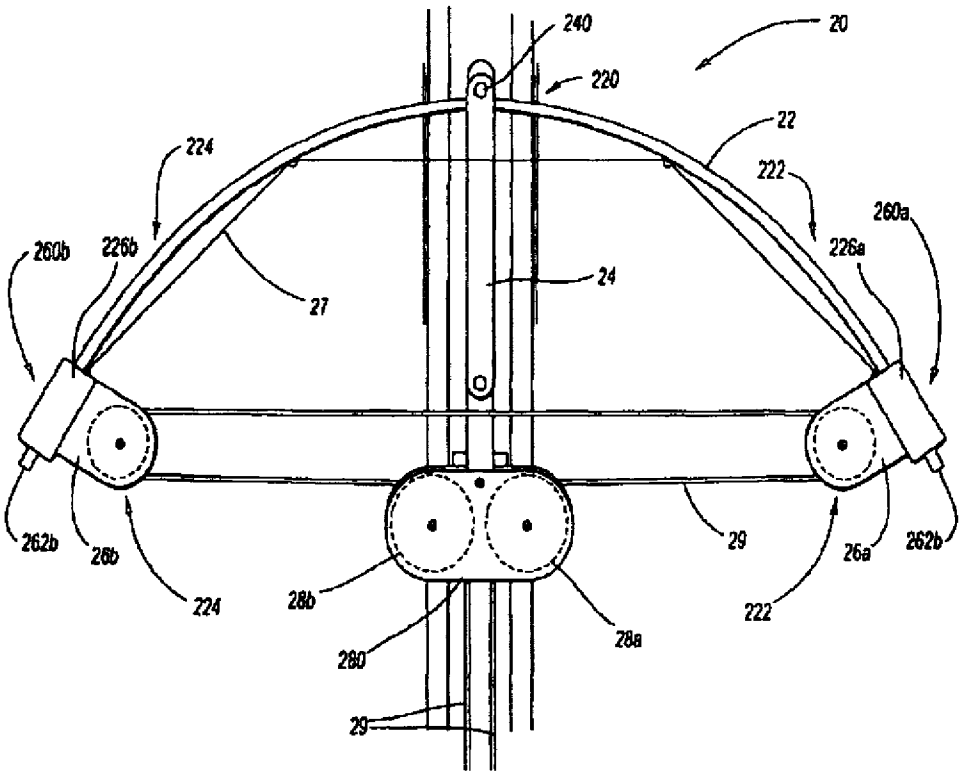
Figure 6:
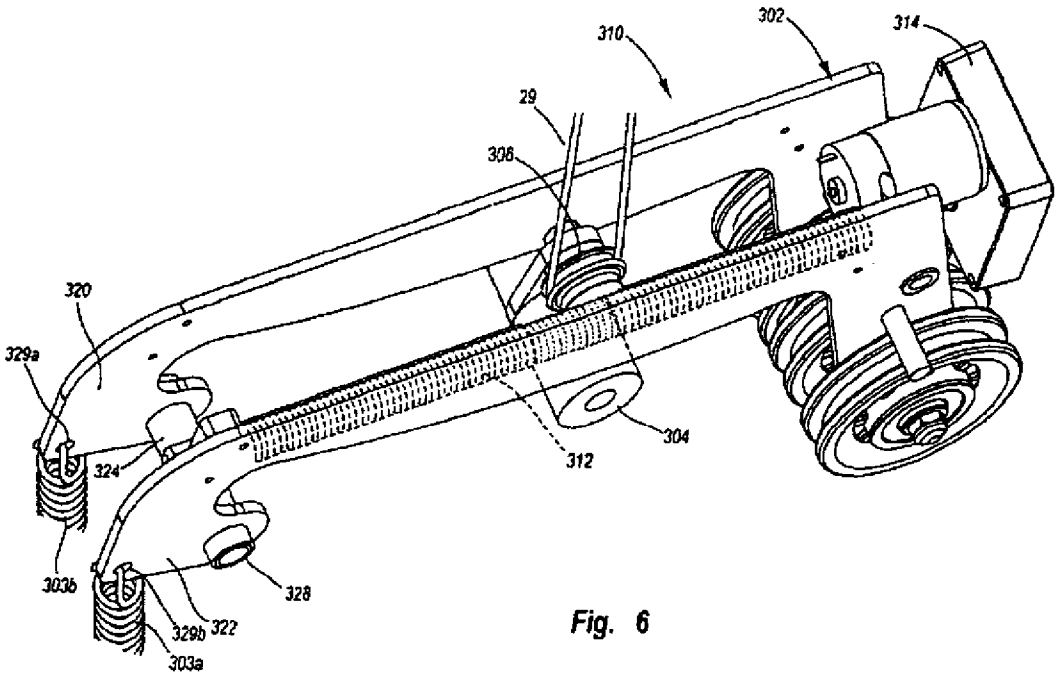

FIG. 8 illustrates a weight selector controller 40 according to one embodiment of the present invention. Weight selector controller 40 allows a user to adjust the amount of resistance provided by the exercise device. In the illustrated embodiment, weight selector controller 40 is adapted to be mounted to upright component support member 18 as illustrated in FIG. 1. Weight selector controller 40 includes a resistance display interface and a toggle selector 404.

In the illustrated embodiment, resistance display interface 402 displays the amount of resistance provided by the exercise apparatus to the user. For example, the depicted "240" represents 240 pounds of resistance being provided by the exercise apparatus. In the illustrated embodiment, resistance display interface 402 comprises a seven segment display. In another embodiment a Liquid Crystal Display is provided. In another embodiment, a Light Emitting Diode display is provided. In another embodiment, a display that displays the amount of the resistance is provided.

Toggle selector 404 provides a mechanism for allowing a user to adjust the amount of resistance provided by the exercise apparatus. When the user depresses the first portion 406, the amount of resistance decreases. When the user depresses the second portion 408, the amount of resistance increases. Toggle selector 404 is connected to the automatic resistance adjustment mechanism 300 depicted in FIG. 5 to actuate lead screw motor assembly 310 and change the position of lever arm length regulator 304. As will be appreciated by those skilled in the art, a variety of electronic weight selector controllers can be utilized with a variety of mechanisms for changing the amount of resistance provided by the exercise apparatus without departing from the scope and spirit of the present invention. For example, in one embodiment the indicia of the electronic weight selector controller comprises one or more of a digital readout, an analog display, and a mechanism for indicating the amount of resistance provided by the single resilient elongate rod in combination with the variable resistance system.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise machine, comprising:

a support frame;

at least one resilient elongate rod having a first end and a second end, wherein the at least one resilient elongate rod is linked to the support frame without the first end or second end being secured to the support frame when providing, resistance for use in exercise;

at least one guide member positioned adjacent at least one side of the at least one resilient elongate rod;

a user interface linked to the at least one resilient elongate rod;

a variable resistance system, wherein the variable resistance system can be utilized in combination with the at least one resilient elongate rod to provide varying amounts of resistance to a user for use during exercise; and a weight selector controller, wherein the weight selector controller can be utilized to change the amount of resistance provided by the at least one resilient elongate rod in combination with the variable resistance system.

2. The exercise machine of claim 1, wherein the at least one resilient elongate rod comprises a single resilient elongate rod.

3. An exercise machine, comprising:

a support frame;

at least one resilient elongate rod linked to the support frame, the at least one resilient elongate rod configured to provide resistance for use in exercise;

at least one guide member positioned adjacent at least one side of the at least one resilient elongate rod;

a variable resistance system, wherein the variable resistance system can be utilized in combination with the at least one resilient elongate rod to provide varying amounts of resistance to a user for use in exercise;

a weight selector controller, wherein the weight selector controller can be utilized to change the amount of resistance provided by the at least one resilient elongate rod in combination with the variable resistance system;

a cable and pulley system linked to the resilient elongate rod to enable the user to move the at least one resilient elongate rod during exercise; and a user interface linked to the at least one resilient elongate rod by the cable and pulley system.

4. An exercise machine, comprising:

a support frame;

a single resilient elongate rod linked to the support frame, the resilient elongate rod configured to provide resistance for use in exercise, the single resilient elongate rod including a center portion, a first end and a second end, wherein the first end is at substantially the same elevation as the center portion when the single resilient elongate rod is in a relaxed position;

a plurality of guide members cooperating with the single resilient elongate rod, wherein the first end and the second end of the resilient elongate rod move with respect to the plurality of guide members when flexed during exercise; and a user interface linked to the single resilient elongate rod.

5. The exercise machine of claim 4, wherein the plurality of guide members are provided as part of a guide mechanism.

6. The exercise machine of claim 4, wherein the plurality of guide members maintain movement of the single resilient elongate rods in a given plane during flexing of the single resilient elongate rod.

7. The exercise machine of claim 4, wherein plurality of guide members are positioned on opposing sides of the single resilient elongate rod.

8. The exercise machine of claim 4, wherein the plurality of guide members comprise a first guide member and a second guide member.

9. The exercise machine of claim 8, wherein the first guide member is positioned adjacent one side of the single resilient elongate rod and the second guide member is positioned adjacent the opposite side of the single resilient elongate rod.

10. The exercise machine of claim 4, further comprising a cable and pulley system linked to the resilient elongate rod to enable the user to move the single resilient elongate rod during exercise.

11. An exercise machine, comprising:

a support frame;

a single resilient elongate rod linked to the support frame, the resilient elongate rod configured to provide resistance for use in exercise;

a user interface linked to the single resilient elongate rod;

a first guide member positioned adjacent one side of the resilient elongate rod, wherein the first guide member minimizes movement of the single resilient elongate rod in the direction toward an upright member of the support frame; and a second guide member positioned adjacent an opposite side of the resilient elongate rod, wherein the second guide member minimizes movement of the single resilient elongate rod in the direction away from the upright member of the support frame.

12. The exercise machine of claim 11, further comprising a cable and pulley system linked to the resilient elongate rod to enable the user to move the resilient elongate rod during exercise.

13. An exercise machine, comprising:

a support frame;

a single resilient elongate rod linked to the support frame, the resilient elongate rod configured to provide resistance for use in exercise;

a first guide member positioned adjacent one side of the resilient elongate rod, wherein the first guide member minimizes movement of the single resilient elongate rod in the direction toward an upright member of the support frame; and a second guide member positioned adjacent an opposite side of the resilient elongate rod, wherein the second guide member minimizes movement of the single resilient elongate rod in the direction away from the upright member of the support frame, wherein the combination of the first and second guide members are configured to maintain smooth and consistent movement of the resilient elongate rod when the resilient elongate rod is flexed.

14. An exercise machine, comprising:

a support frame;

a single resilient elongate rod linked to the support frame, the resilient elongate rod configured to provide resistance for use in exercise;

a first guide member positioned adjacent one side of the resilient elongate rod;

a second guide member positioned adjacent an opposite side of the resilient elongate rod, wherein the combination of the first and second guide members are configured to maintain smooth and consistent movement of the resilient elongate rod when the resilient elongate rod is flexed; and a riser coupler, wherein the riser coupler provides a desired amount of displacement between the first guide member and the second guide member.

15. The exercise machine of claim 14, wherein the length of the riser coupler approximates the width of the single resilient elongate member.

16. An exercise machine, comprising:

a support frame comprising an upright support member coupled to a support base;

a single resilient elongate rod positioned adjacent the support frame, the resilient elongate rod configured to provide resistance for use in exercise and having first and second ends;

a user interface linked to the first and second ends of the single resilient elongate rod by a cable and pulley system; and a weight selector controller configured to allow a user to change the amount of resistance provided by the single resilient elongate rod.

17. The exercise machine of claim 16, wherein the weight selector controller comprises an electronic weight selector controller.

18. The exercise machine of claim 16, wherein the weight selector controller is one component of an electronic resistance selector system, and wherein the electronic resistance selector system includes a variable resistance system.

19. The exercise machine of claim 18, wherein the weight selector controller controls operation of the variable resistance system.

20. The exercise machine of claim 16, wherein the weight selector controller is configured to allow a user to select the amount of resistance to be utilized during an exercise routine.

21. The exercise machine of claim 16, wherein weight selector controller comprises a bi-directional controller.

22. The exercise machine of claim 21, wherein the bi-directional controller is configured to allow the user to increase or decrease the amount of resistance provided by the single resilient elongate rod during exercise.

23. The exercise machine of claim 22, wherein the bi-directional controller comprises a bi-directional switch.

24. The exercise machine of claim 23, wherein the bi-directional controller is selected from the group consisting of a digital controller, an analog controller, a solid state element, a manual mechanism, and a mechanism for controlling the amount of resistance provided by the resilient elongate rod in combination with a variable resistance system.

25. The exercise machine of claim 21, wherein the bi-directional controller is configured to actuate in one direction to increase the amount of resistance provided by the single resilient elongate rod in combination with a variable resistance system and the bi-directional controller is configured to actuate in the opposite direction to decrease the amount of resistance provided by the single resilient elongate rod in combination with the variable resistance system.

26. An exercise machine, comprising:

a support frame;

a single resilient elongate rod positioned adjacent the support frame, the resilient elongate rod configured to provide resistance for use in exercise, wherein the single resilient elongate rod includes a first end and a second end, wherein both the first end and the second end move toward each other as the single resilient elongate rod flexes during exercise;

a user interface linked to the first and second ends of the single resilient elongate rod;

a resistance selector system cooperating with the single resilient elongate rod, the resistance selector system having a bi-directional controller enabling the user to increase or decrease the amount of resistance provided by the resilient elongate rod; and one or more indicia configured to show the amount of resistance provided by the single resilient elongate rod.

27. The exercise machine of claim 26, wherein the one or more indicia comprises a display.

28. The exercise machine of claim 26, wherein the one or more indicia comprise a plurality of indicia.

29. The exercise machine of claim 28, wherein the plurality of indicia comprise indicator lines.

30. The exercise machine of claim 29, wherein the plurality of indicator lines are associated with indicator numerals.

31. The exercise machine of claim 26, wherein the one or more indicia is selected from the group consisting of one or more Light Emitting Diodes, a digital readout, an analog display, and a mechanism for indicating the amount of resistance provided by the single resilient elongate rod in combination with the variable resistance system.

32. The exercise machine of claim 26, further comprising a cable and pulley system linked to the resilient elongate rod to enable the user to move the resilient elongate rod during exercise.

33. An exercise machine, comprising:

a support frame;

a single resilient elongate rod positioned adjacent the support frame, the resilient elongate rod configured to provide resistance for use in exercise;

a user interface linked to the single resilient elongate rod by a cable and pulley system;

a resistance selector system cooperating with the single resilient elongate rod, the resistance selector system having a bi-directional controller enabling the user to increase or decrease the amount of resistance provided by the resilient elongate rod during exercise;

one or more indicia configured to show the amount of resistance provided by the single resilient elongate rod, wherein the one or more indicia comprise a plurality of indicia, wherein the plurality of indicia comprise indicator lines associated with indicator numerals, wherein the indicator numerals are indicative of an amount of resistance provided.

34. The exercise machine of claim 33, wherein the indicator lines are positioned on alternative sides of a groove accommodating a resistance cable.

35. The exercise machine of claim 34, wherein a position of the resistance cable relative to the indicator lines provides and indication of the amount of resistance provided during exercise.

36. The exercise machine of claim 35, wherein the juxtaposition of the plurality of indicator lines allow the user to quickly ascertain the amount and direction of change in resistance when operating the weight selector controller.

37. An exercise machine, comprising:

a support frame;

at least one resilient elongate rod positioned adjacent the support frame, the at least one resilient elongate rod configured to provide resistance for use in exercise;

a cable and pulley system linked to the at least one resilient elongate rod to enable a user to move the resilient elongate rod during exercise;

a user interface linked to the at least one resilient elongate rod by the cable and pulley system; and a repetition sensor configured to monitor the number of repetitions conducted during an exercise routine, wherein the repetition sensor includes a first and second disk.

38. The exercise machine of claim 37, wherein the repetition sensor comprises a magnetic sensor.

39. The exercise machine of claim 37, wherein the repetition sensor comprises an optical sensor.

40. The exercise machine of claim 37, wherein each of the first and second disks include voids, wherein the voids of the first disk are offset from the voids of the second disk.

41. The exercise machine of claim 37, wherein the repetition sensor includes a first sensor associated with the first disk and a second sensor associated with the second disk.

42. An exercise machine, comprising:

a support frame;

at least one resilient elongate rod positioned adjacent the support frame to provide resistance for use during exercise;

a lever arm coupled to the resilient elongate rod to allow the user to vary the amount of resistance experienced during exercise by changing the effective length of the lever arm; and a bias spring linked to the lever arm providing a source of resistance, wherein the bias spring allows a minimum amount of resistance to be provided where the effective length of the lever arm would provide less than a minimum amount of resistance from the resilient elongate rod.

43. The exercise machine of claim 42, wherein the bias spring comprises a resilient member.

44. The exercise machine of claim 42, wherein the lever arm is utilized in connection with a variable resistance system for controlling the amount of resistance provided by the at least resilient elongate rod.

45. The exercise machine of claim 44, wherein the lever arm includes a pivot near one end of the lever arm and a plurality of pulleys near the other end of the lever arm.

46. The exercise machine of claim 45, wherein the bias spring is coupled to the end of the lever arm adjacent the pivot.

47. The exercise machine of claim 45, where the bias spring is coupled to the end of the lever arm adjacent the pulleys.

* * * * *

UNITED STATES PATENT AND TRADEMARK OFFICE

CERTIFICATE OF CORRECTION

PATENT NO. : 7,429,236 B2
APPLICATION NO. : 10/968250
DATED : September 30, 2008
INVENTOR(S) : Dalebout et al.

It is certified that error appears in the above-identified patent and that said Letters Patent is hereby corrected as shown below:

Drawings

Sheet 5, please replace the current drawing of Figure 4B with the following figure in which "28a" and "28b" have been switched in order to be consistent with the previous figures.

Sheet 7, please replace the current drawing of Figure 6 with the following figure in which the "resistance cable 29" is depicted, and reference number "306" is removed.

Column 2
Line 24, change "member" to --members--.

Column 5
Lines 15 and 16, change "pivot member" to --folding pivot--.
Line 43, change "deck 160" to --base 16--.
Lines 55 and 57, change "support deck" to --support base 16--.

Column 6
Line 32, remove "a".
Line 53, change "86" to --86a--.

Column 7
Line 34, change "member" to --members--.

Column 8
Line 23, change "flexes 22" to --22 flexes--.
Line 29, change "rod" to --rod 22--.

Column 10
Lines 4 and 6, change "regular" to --regulator--.
Line 9, change "assembly" to --assembly 310--.

UNITED STATES PATENT AND TRADEMARK OFFICE

CERTIFICATE OF CORRECTION

PATENT NO. : 7,429,236 B2
APPLICATION NO. : 10/968250
DATED : September 30, 2008
INVENTOR(S) : Dalebout et al.

It is certified that error appears in the above-identified patent and that said Letters Patent is hereby corrected as shown below:

Column 11
Line 14, change "cables" to --pulleys--.
Line 18, change "angel" to --angle--.
Line 21, change "rod" to --rod 22--.
Line 59, change "20" to --30--.

Column 12
Line 12, change "system" to --system 30--.
Line 55, change "regulator" to --regulator 304--.

Column 13
Line 61, change "202" to --302--.

Column 14
Line 40, change "regulator" to --regulator 304--.

Column 15
Line 4, change "member" to --rod--.

Signed and Sealed this

First Day of September, 2009

David J. Kappos

David J. Kappos
*Director of the United States Patent and Trademark Office*